US008957843B2

(12) United States Patent
Okuno et al.

(10) Patent No.: US 8,957,843 B2
(45) Date of Patent: Feb. 17, 2015

(54) GATE SELECTION CIRCUIT OF LIQUID CRYSTAL PANEL, ACCUMULATING CAPACITY DRIVING CIRCUIT, DRIVING DEVICE, AND DRIVING METHOD

(75) Inventors: Takeshi Okuno, Tsurumi-ku (JP); Hirofumi Katsuse, Tsurumi-ku (JP); Kazuhiro Matsumoto, Tsurumi-ku (JP)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 935 days.

(21) Appl. No.: 13/033,051

(22) Filed: Feb. 23, 2011

(65) Prior Publication Data

US 2011/0205196 A1 Aug. 25, 2011

(30) Foreign Application Priority Data

Feb. 25, 2010 (JP) ..... 2010-040633
Feb. 18, 2011 (KR) ..... 10-2011-0014695

(51) Int. Cl.
*G09G 3/36* (2006.01)
*G09G 5/00* (2006.01)
*G06F 3/038* (2013.01)

(52) U.S. Cl.
CPC ..... *G09G 3/3674* (2013.01); *G09G 2310/08* (2013.01)
USPC ..... 345/100; 345/204

(58) Field of Classification Search
CPC . G09G 3/3266; G09G 3/3611; G09G 3/3655; G09G 3/3674; G09G 2310/0267
USPC ..... 345/94, 100, 208; 326/46, 93–98; 327/199, 200; 361/749; 377/64–81
See application file for complete search history.

(56) References Cited

U.S. PATENT DOCUMENTS

| | | | | |
|---|---|---|---|---|
| 5,883,609 | A | 3/1999 | Asada et al. | |
| 8,115,719 | B2 | 2/2012 | Fujita | |
| 2008/0218502 | A1 * | 9/2008 | Lee et al. | 345/208 |
| 2008/0316156 | A1 | 12/2008 | Shigaki et al. | |
| 2009/0273554 | A1 * | 11/2009 | Fujita | 345/94 |
| 2010/0085294 | A1 * | 4/2010 | Otose | 345/100 |

FOREIGN PATENT DOCUMENTS

| | | | |
|---|---|---|---|
| JP | 08122747 | A | 5/1996 |
| JP | 08153583 | | 6/1996 |
| JP | 09061788 | A | 3/1997 |
| JP | 2001-356728 | | 12/2001 |
| JP | 2002358051 | | 12/2002 |
| JP | 2005234077 | | 9/2005 |
| JP | 2008180761 | A | 8/2008 |
| JP | 2008309922 | A | 12/2008 |
| JP | 2009223051 | | 10/2009 |
| JP | 2009271212 | A | 11/2009 |
| KR | 1020060052038 | A | 5/2006 |
| KR | 1020070103183 | A | 10/2007 |
| WO | 2009084280 | A1 | 7/2009 |

* cited by examiner

*Primary Examiner* — Andrew Sasinowski
*Assistant Examiner* — Nguyen H Truong
(74) *Attorney, Agent, or Firm* — Robert E. Bushnell, Esq.

(57) ABSTRACT

The present invention relates to the circuit size of a gate selection circuit of an active matrix liquid crystal panel. A plurality of clock signals are generated by a clock generation circuit, a shift register is formed by a plurality of latch circuits, and hold information is shifted in synchronization with enable clock signals. In a switch circuit, a plurality of clock signals are sequentially outputted as gate selection signals according to each output signal of the latch circuits. A driving method and a driving apparatus of the gate selection circuit are also disclosed.

21 Claims, 20 Drawing Sheets

GATE SELECTION CIRCUIT OF LIQUID CRYSTAL PANEL, ACCUMULATING CAPACITY DRIVING CIRCUIT, DRIVING DEVICE, AND DRIVING METHOD

CLAIM OF PRIORITY

This application makes reference to, incorporates the same herein, and claims all benefits accruing under 35 U.S.C. §119 from an application earlier filed in the Korean. Intellectual Property Office on 18 Feb. 2011 and there duly assigned Serial No. 10-2011-0014695, and an application earlier filed in the Japan Patent Office on the 25 Feb. 2010 and there duly assigned Serial No. 2010-040633.

BACKGROUND OF THE INVENTION

1. Field of the Invention

The present invention relates to a gate selection circuit of an active matrix liquid crystal panel, an accumulating capacity driving circuit, a driving apparatus, and a driving method.

2. Description of the Related Art

A gate selection circuit comprises a shift register circuit including a plurality of latch circuits, and clock signals may be used as clock signals of the latch circuit. Gate selection signals are generated from each output of a plurality of the latch circuits. Furthermore, each latch circuit includes two clock inverters circuit and one inverter circuit.

In the gate selection circuit, one latch circuit is respectively required for one gate selection circuit output (one output signal among the gate selection signals). Also, a control signal to operate the latch circuit is required.

The latch circuit is referred to as a general latch circuit, and the latch circuit including two inverter circuits is referred to as a bus latch circuit.

An accumulating capacity driving circuit includes a shift register circuit comprising a plurality of latch circuits, like the gate selection circuit, and the clock signals may be used as clock signals of the general latch circuit. Also, an accumulating capacity driving signal is generated from the latch circuit output.

As described above, in the accumulating capacity driving circuit, like the gate selection circuit, one latch circuit is required for one accumulating capacity driving circuit output (one output signal among the accumulating capacity driving signals). Also, a control signal to operate the latch circuit is necessary.

A liquid crystal panel includes a plurality of gate lines arranged by a plurality of electrodes in a horizontal direction, a plurality of accumulating capacity lines equally arranged by a plurality of electrodes in the horizontal direction, and a plurality of source lines arranged by a plurality of electrodes in a vertical direction.

A pixel, including a thin film transistor (TFT) switch, a liquid crystal capacitor and an accumulating capacitor, is formed in each intersection portion of the gate line and the source line.

The liquid crystal panel is connected to a gate selection circuit so as to drive the plurality of gate lines, an accumulating capacity driving circuit so as to drive the plurality of accumulating capacity lines, and a source driving circuit so as to drive the plurality of source electrodes.

For one scan period, the gate selection circuit sequentially selects the TFT of the pixel connected to the gate line, and simultaneously writes the desired data voltage from the source driving circuit to the liquid crystal.

Also, after writing the data voltage, by overlapping a predetermined voltage from the accumulating capacity driving circuit, the data written to the liquid crystal capacitor is converted into a voltage which is suitable for the optical characteristic of an actual liquid crystal, and the converted voltage is maintained to a next frame.

Japanese Patent Laid-Open Publication No. 2009-223051 discloses a display device and a driving method of a display device.

In this display device, an objective is to realize a display device which is capable of smoothing a high density of the shift register circuit. To achieve this objective, the gate circuits are disposed on both sides of the panel, thereby reducing the density of the circuit.

The output of the shift register circuit (SR) of one side of the panel, among the SRs configuring the gate circuit, is transmitted to a scan electrode of the panel display area, and is used as the input of the SR of one side, and thereby the SRs disposed on both sides of the panel are operated as one SR.

The above information disclosed in this Background section is only for enhancement of an understanding of the background of the invention, and therefore it may contain information which does not form the prior art which is already known in this country to a person of ordinary skill in the art.

SUMMARY OF THE INVENTION

As described above, in a gate circuit, one latch circuit is required for one gate selection circuit output.

Also, in the accumulating capacity driving circuit, one latch circuit is needed for one accumulating capacity driving circuit output. In addition, a control signal to drive the latch circuit is necessary so that an increase in the entire number of circuits is inevitable to apply them to the panel. As a result, an increase in the panel area is problematic.

To decrease the panel area, a means capable of decreasing the entire number of circuits is necessary while maintaining the other functions.

The present invention decreases the scale of the circuit in the gate selection circuit of the active matrix liquid crystal panel.

Furthermore, in the invention, a driving apparatus of a liquid crystal panel is capable of reducing the scale of an accumulating capacity driving circuit and the scale of an entire circuit area.

In accordance with the invention, the gate selection circuit drives an active matrix liquid crystal panel, including a plurality of pixels arranged in a matrix format, and having a thin film transistor switch, a liquid crystal capacitor, and an accumulating capacitor at a plurality of regions intersected by a plurality of gate lines and a plurality of accumulating capacity driving lines disposed in a horizontal direction, and a plurality of source lines disposed in a vertical direction. According to the present invention, the gate selection circuit comprises: a clock generation circuit generating an enable clock signal generated by frequency-dividing a predetermined horizontal synchronization signal synchronized with an image signal for display in a liquid crystal panel, and a plurality of clock signals generated from a predetermined vertical synchronization clock signal and the enable clock signal, and having different phases; a plurality of first latch circuits connected in series, thereby forming a shift register and shifting hold information in synchronization with the enable clock signal; and a first switch circuit installed in correspondence to the gate lines, and when supplying the clock signal to each the gate line as a gate selection signal of the pixel, sequentially outputting the gate selection signals according to the output signal of the first latch circuit.

By this configuration, a plurality of clock signals are generated by the clock generation circuit.

Also, a shift register is configured by a plurality of latch circuits, and hold information is shifted in synchronization with an enable clock signal.

In addition, in the switch circuit, according to the output signal of the latch circuit, a plurality of clock signals are sequentially outputted as gate selection signals.

Accordingly, the entire circuit size of the gate selection circuit may be reduced, and the circuit area may be reduced.

The gate selection circuit of the present invention sequentially outputs a plurality of clock signals, generated by the clock generation circuit, to the switch circuit as the gate selection signals according to the output signal from the latch circuit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
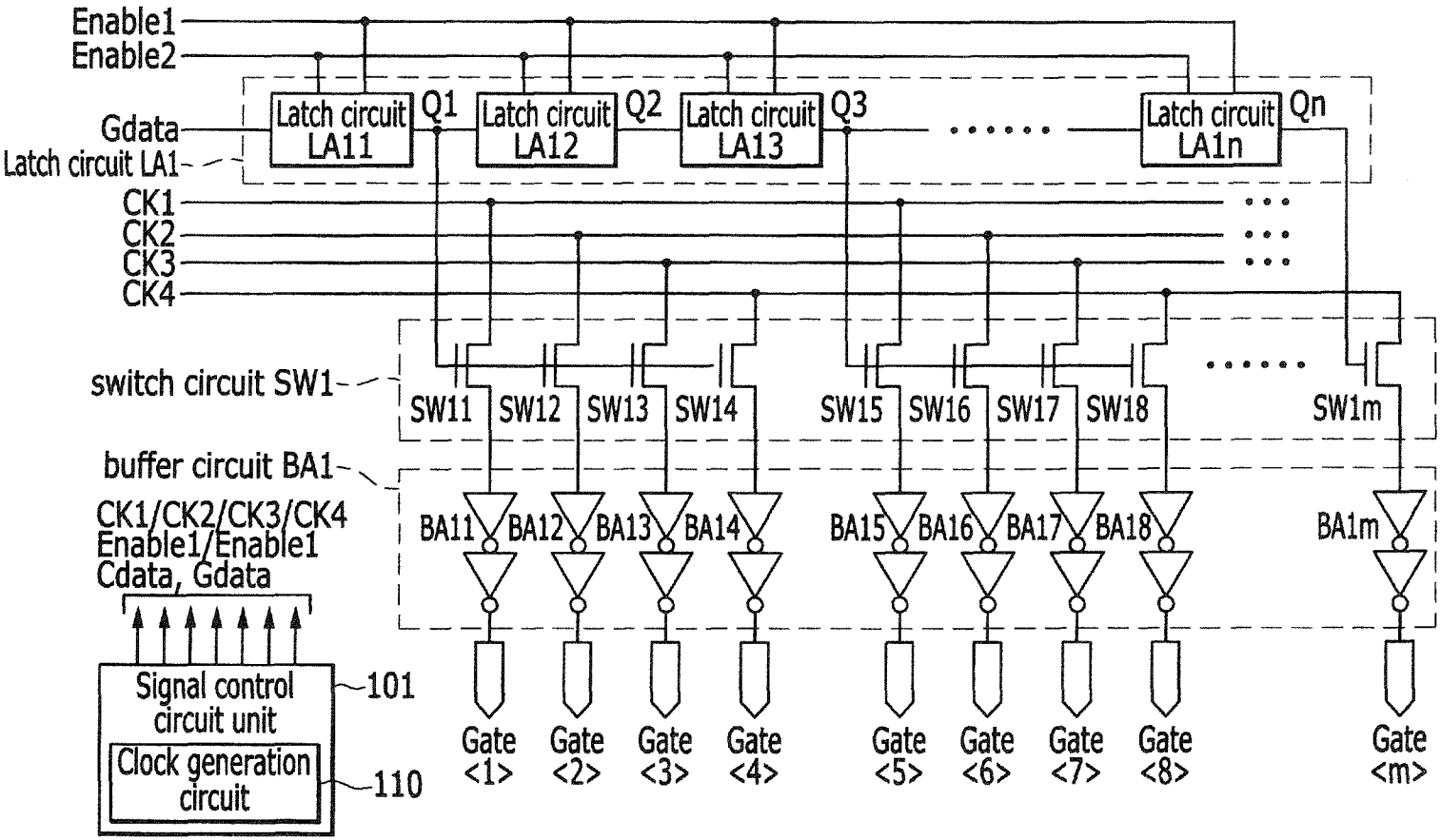
FIG. 1 is a view showing the constitution of a gate selection circuit according to a first exemplary embodiment of the present invention.

In the following detailed description, only certain exemplary embodiments of the present invention have been shown and described, simply by way of illustration. As those skilled in the art will realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

FIG. 1 is a view showing the constitution of a gate selection circuit according to a first exemplary embodiment of the present invention.

A gate selection circuit 11 shown in FIG. 1 includes a latch circuit LA1 having a plurality of latch circuits LA11-LA1*m* connected in series, a switch circuit SW1 to select a desired gate signal from a 4-phase clock signal, and a buffer circuit BA1 to output each gate selection signal (a gate output).

Also, enable clock signals Enable1 and Enable2, clock signals CK1, CK2, CK3 and CK4, and a data signal Gdata supplied to the gate selection circuit 11 are supplied from a signal control circuit unit 101.

The signal control circuit unit 101 will be described later with reference to FIG. 15.

As shown in FIG. 1, the latch circuit LA1 includes a plurality of latch circuits LA11-LA1*n* which are connected in series, and the data signal Gdata inputted to the initial latch circuit LA11 is sequentially shifted by the enable clock signals Enable1 and Enable2, and is outputted as a plurality of output signals Q1, Q2, Q3, . . . , Qn.

The odd-numbered output signals Q1, Q3, Q5, . . . among the plurality of output signals Q1, Q2, Q3, . . . , Qn, are outputted to the switch circuit SW1.

The plurality of latch circuits LA11-LA1*n* are respectively half latch circuits, and they adjust timing for the 4-phase clock signals CK1, CK2, CK3 and CK4 such that two latch circuits are required for each 4-phase clock signal. Also, the plurality of latch circuits LA11-LA1*n* respectively include a general latch circuit shown in FIG. 20A (disclosed below).

Each of the switch circuits SW11-SW1*m* in the switch circuit SW1 is made of an MOS transistor, and corresponds to the 4-phase clock signals CK1, CK2, CK3 and CK4. Four switch circuits are grouped as one unit, thereby forming the switch circuit SW1.

For example, the switch circuits SW11-SW14 are one unit, the gates of the switch circuits SW11-SW14 are commonly connected, and the output signal Q1 of the latch circuit LA11 is inputted to the gates which are commonly connected.

Furthermore, the drain of the switch circuit SW11 received the clock signal CK1 as an input, and the signal outputted to the source is the input of the buffer circuit BA11, and is outputted as the gate selection signal Gate<1>.

The drain of the switch circuit SW12 receives the clock signal CK2 as an input, and the signal outputted to the source is the input of the buffer circuit BA12, and is outputted as the gate selection signal Gate<2>.

The drain of the switch circuit SW13 receives the clock signal CK3 as an input, and the signal outputted to the source is the input of the buffer circuit BA13, and is outputted as the gate selection signal Gate<3>.

The drain of the switch circuit SW14 receives the clock signal CK4 as an input, and the signal outputted to the source is the input of the buffer circuit BA14, and is outputted as the gate selection signal Gate<4>.

By the same method, the switch circuits SW15-SW18 are grouped as one unit, the gates of the switch circuits SW15-SW18 are commonly connected, and the output signal Q3 of the latch circuit LA13 is inputted to the gates which are commonly connected.

The drain of the switch circuit SW15 receives the clock signal CK1 as an input, and the signal outputted to the source is the input of the buffer circuit BA15, and is outputted as the gate selection signal Gate<5>. The above description also applies to the buffer circuits BA11-BA1*m*.

As described above, the output of each of the buffer circuits BA11-BA1*m* is respectively connected to the gate line output terminals Gate<1>, Gate<2>, Gate<3>, Gate<4>, . . . , Gate<m>, where the number of gate lines of the liquid crystal panel is m, and the number of necessary gate outputs is m.

Figure 13A:
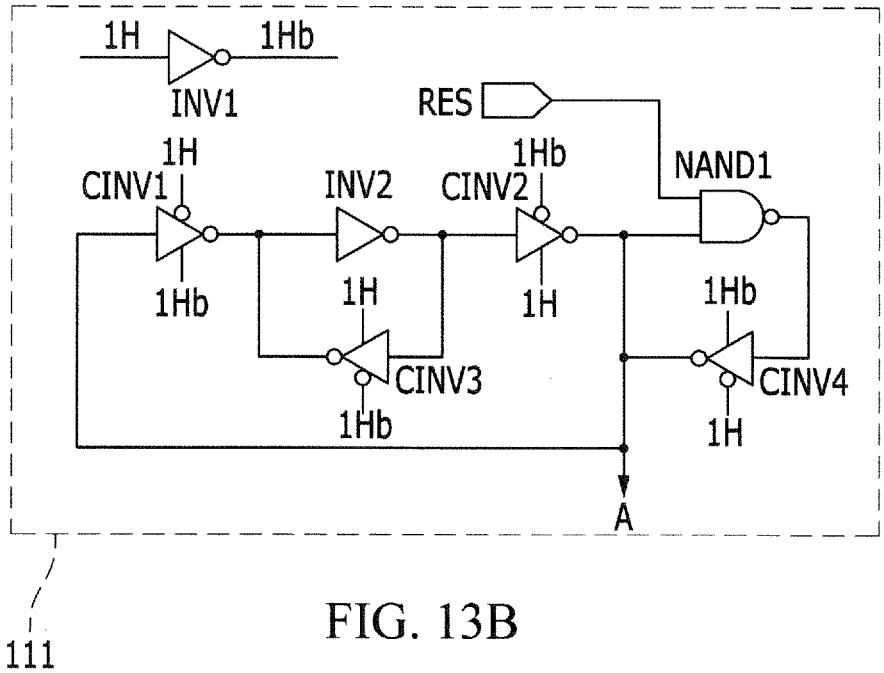
FIGS. 13A thru 13C are views showing the constitution of a clock generation circuit so as to generate a control signal of a gate selection circuit.
Figure 13B:
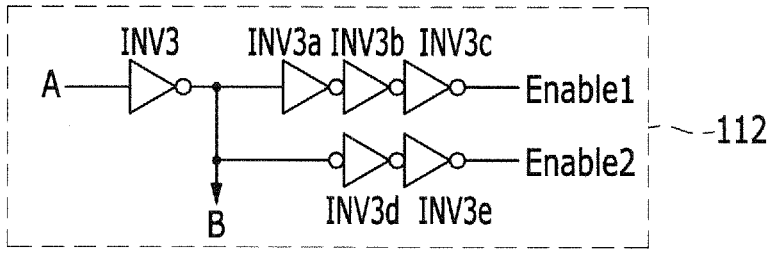
Figure 13C:
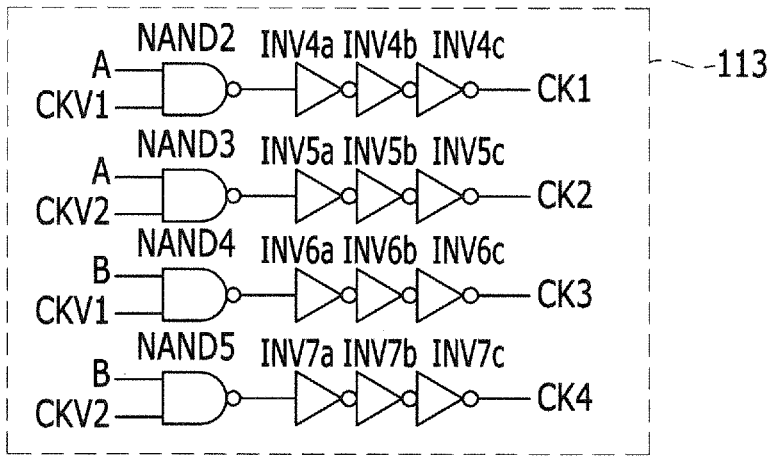
Figure 14:
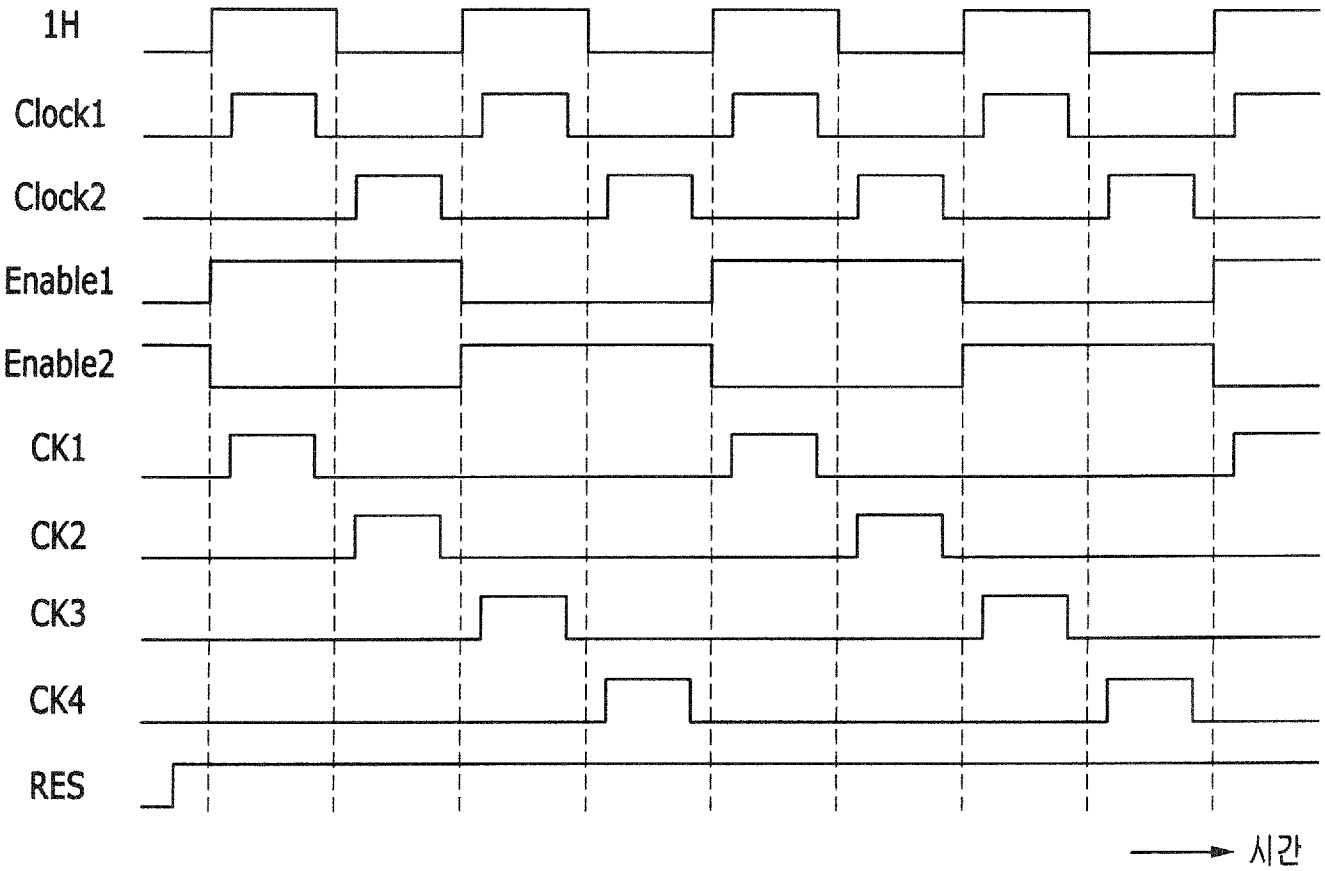
FIG. 14 is a view showing the operation waveform of the clock generation circuit shown in FIG. 13.

Next, the constitution of a clock generation circuit and the operation of generating the control signal of the gate selection circuit 11, shown in FIG. 1, are shown in FIG. 13 and FIG. 14.

FIGS. 13A thru 13C are views showing the constitution of a clock generation circuit so as to generate a control signal of a gate selection circuit; and FIG. 14 is a view showing the operation waveform of the clock generation circuit shown in FIG. 13.

The clock generation circuit is a circuit generating the enable clock signals Enable1 and Enable2 and 4-phase clock signals CK1, CK2, CK3 and CK4 of the gate selection circuit shown in FIG. 1, and includes a frequency-divided circuit 111 of FIG. 13A, an enable clock signal generation circuit 112 of FIG. 13B, and a 4-phase clock generation circuit 113 of FIG. 13C.

The frequency-divided circuit 111 of FIG. 13A is controlled by a horizontal synchronization signal 1H and a horizontal synchronization signal 1Hb, of which the horizontal synchronization signal 1H is logic inverted by an inverter circuit INV1.

In this frequency-divided circuit 111, a clock inverter circuit CINV1, an inverter circuit INV2, and a clock inverter circuit CINV2 are dependently connected, and the output side of the clock inverter circuit CINV2 is connected to the input side of the clock inverter circuit CINV1.

Also, the output signal of the clock inverter circuit CINV2 is the input signal applied to one input terminal of a NAND circuit NAND1, and the other input terminal of the NAND circuit NAND1 is inputted with a signal RES for controlling movement and stoppage of the frequency-divided circuit 111.

Also, a clock inverter circuit CINV4 is connected between the output side and one input side of the NAND circuit NAND1. The inverter circuit INV1 receives the horizontal synchronization signal 1H, and a signal A which has a frequency which is one-half the frequency of the horizontal synchronization signal 1H is obtained by the signal RES of H.

This signal A is inputted to the enable clock signal generation circuit 112 of FIG. 13B.

In the enable clock signal generation circuit 112 of FIG. 13B, four inverter circuits INV3, INV3*a*, INV3*b* and INV3*c* are connected in series, and two inverter circuits INV3*d* and INV3*e* are connected in series to the output side of the inverter circuit INV3.

The enable clock signal generation circuit 112 is inputted with the signal A which is outputted from the frequency-divided circuit 111, and thereby the signal B is outputted from the inverter circuit INV3, the enable clock signal Enable1 is outputted from the inverter circuit INV3*c*, and the enable clock signal Enable2 is outputted from the inverter circuit INV3*e*.

These enable clock signals Enable1 and Enable2 are the enable clock signals Enable1 and Enable2 of the gate selection circuit 11 shown in FIG. 1. On the other hand, the signal B is an inversion signal of the signal A.

Also, the signal A and the signal B are respectively inputted to the NAND circuits NAND2-NAND5 of the 4-phase clock generation circuit 113 shown in FIG. 13C along with the vertical clock signals CKV1 and CKV2.

The NAND circuit NAND2 is inputted with the signal A and the vertical clock signal CKV1, and the clock signal CK1 is obtained by the inverter circuits INV4*a*, INV4*b*, and INV4*c*.

The NAND circuit NAND3 is inputted with the signal A and the vertical clock signal CKV2, and the clock signal CK2 is obtained through the inverter circuits INV5*a*, INV5*b*, and INV5*c*.

The NAND circuit NAND4 is inputted with the signal B and the vertical clock signal CKV1, and the clock signal CK3 is obtained through the inverter circuits INV6*a*, INV6*b*, and INV6*c*.

The NAND circuit NAND5 is inputted with the signal B and the vertical clock signal CKV2, and the clock signal CK4 is obtained through the inverter circuits INV7*a*, INV7*b*, and INV7*c*.

As described above, the 4-phase clock signals CK1, CK2, CK3, and CK4 may be obtained.

FIG. 14 shows the operation timing in detail.

In the timing chart shown in FIG. 14, the horizontal synchronization signal 1H, the clock signal Clock1, the vertical clock signal CKV1, the clock signal Clock2, the vertical clock signal CKV2, the enable clock signals Enable1 and Enable2, the 4-phase clock signals CK1/CK2/CK3/CK4, and the frequency-divided circuit control signal RES are shown.

As shown in FIG. 14, when the signal RES, which is shown at the lowest end, becomes a level H of the high level, the frequency-divided circuit 111 starts to be operated, and 4-phase clock signals CK1, CK2, CK3 and CK4 are generated by the generation horizontal synchronization signal 1H and the vertical clock signal CKV 1 and CKV2.

Now, an accumulating capacity driving circuit 12 according to the first exemplary embodiment of the present invention will be described.

Figure 2:
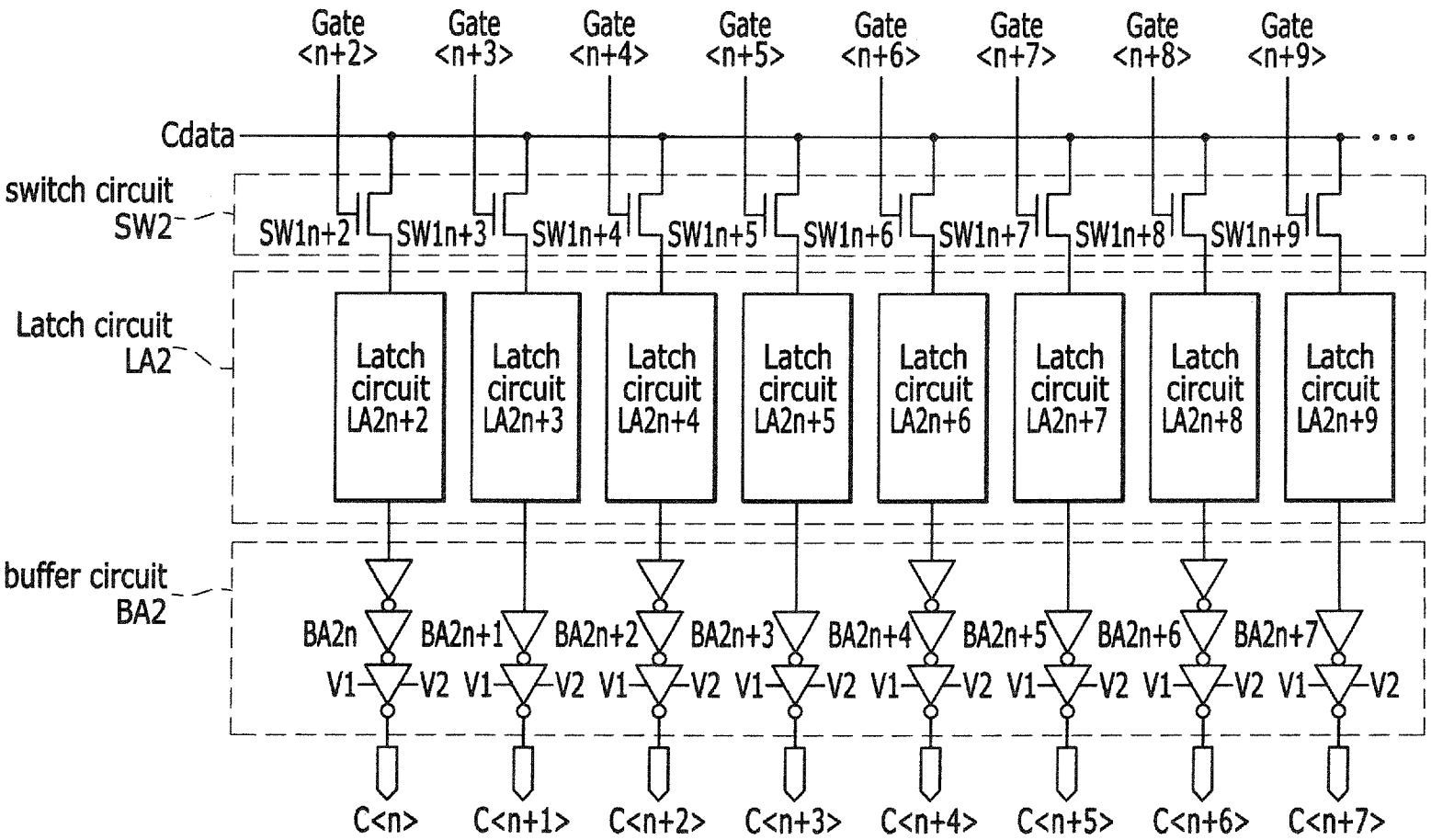
FIG. 2 is a view showing the constitution of an accumulating capacity driving circuit according to the first exemplary embodiment of the present invention.

FIG. 2 is a view showing an accumulating capacity driving circuit according to the first exemplary embodiment of the present invention.

The accumulating capacity driving circuit 12 of the present invention, as shown in FIG. 2, includes a latch circuit LA2 including a plurality of latch circuits LA2*n*+2-LA2*n*+9, a switch circuit SW2 including a plurality of switch circuits SW2*n*+2-SWn+9 for selecting an accumulating capacity driving data signal Cdata inputted to the latch circuit LA2, and a buffer circuit BA2 including a plurality of buffer circuits BAn-BAn+7 for outputting the accumulating capacity output from each latch circuit output.

On the other hand, ⌈n⌋ is an address (a vertical direction: Y) representing the n-th gate line, and for example, ⌈n+2⌋ represents the (n+2)-th gate line in the vertical direction.

As shown in FIG. 2, each of the switch circuits SW2*n*+2-SW2*n*+9 is made of an MOS transistor, and each gate is respectively inputted with the gate selection signals Gate<n+2>, Gate<n+3>, . . . , Gate<n+9> from the gate selection circuit 11.

Each drain of the switch circuits SW2*n*+2-SW2*n*+9 is commonly connected, and the data signal Cdata is inputted to the drains which are commonly connected.

Each source of the switch circuits SW2*n*+2-SW2*n*+9 is respectively connected to the data input side of the latch circuits LA2 LA2*n*+2-LA2*n*+9.

Each data output side of the latch circuits LA2 LA2*n*+2-LA2*n*+9 is respectively connected to the input side of the buffer circuits BA2*n*-BA2*n*+7 of buffer circuit BA2, and each output side of the buffer circuits BA2*n*-BA2*n*+7 is respectively connected to the accumulating capacity line output terminals C<n>, C<n+1>, . . . , C<n+7.

When the number of accumulating capacity lines of the liquid crystal panel is m, the required accumulating capacity output is m.

On the other hand, in the example shown in FIG. 2, the driving timing is actually adjusted between the gate line GL of the liquid crystal panel and the accumulating capacity line CL, and thereby the vertical direction address of the gate line GL and the vertical direction address of the accumulating capacity line CL have an offset by 2 lines.

Therefore, by means of the gate selection signal Gate<n+2> and the driving signal of the (n+2)-th gate line, the accumulating capacity driving signal C<n> and the driving signal of the n-th source line SL are generated.

Also, the number of inverters forming the buffer circuit BA2*n*-BA2*n*+7 in the buffer circuit BA2 is three for the buffer circuit BA2*n* and two for the buffer circuit BA2*n*+1. Accordingly, the output signal is alternately generated as a different signal level.

Also, the inverter as the buffer circuit for the final output of a plurality of buffer circuits BA2*n*-BA2*n*+7 is driven by power sources V1 and V2 which are capable of being regulated (regulation of contrast of the image is possible).

The inverter access levels of a plurality of buffer circuits BA2*n*-BA2*n*+7 are alternately formed with two levels or three levels.

A plurality of latch circuits LA2*n*+2-LA2*n*+9 are made of bus-type latch circuits.

Figure 20A:
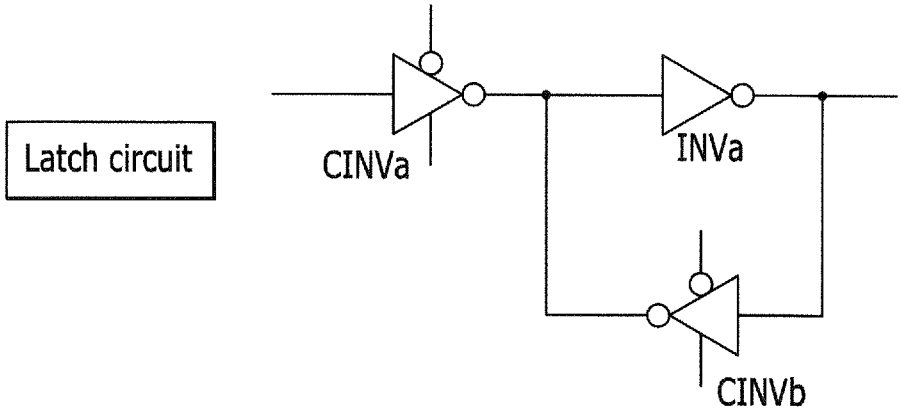
FIGS. 20A and 20B are views showing the constitution of a latch circuit.
Figure 20B:
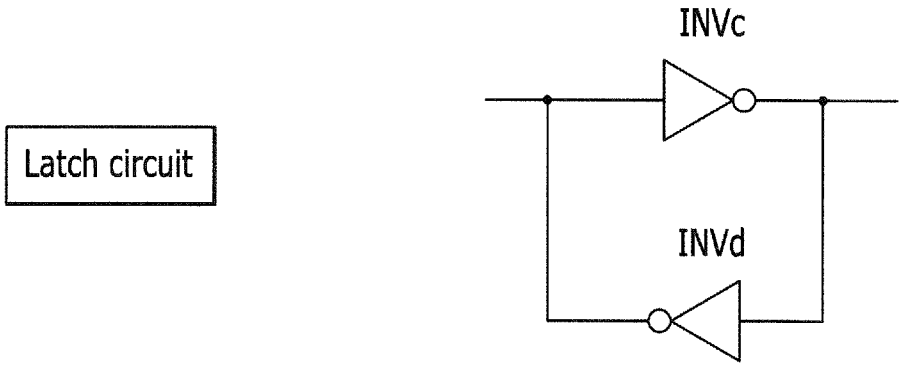

FIGS. 20A and 20B are views showing the constitution of a latch circuit, and show an example of a general latch circuit and a bus-type latch circuit, respectively.

In FIG. 20A, the general latch circuit includes two clock inverter circuits CINVa and CINVb and one inverter circuit INVa, and ten transistors are required as an element.

In FIG. 20B, the bus-type latch circuit includes two inverter circuits INVc and INVd which are inversely connected in parallel. It is realized by four transistors, and thereby it is possible to reduce six transistors in the part of the latch circuit.

Next, an entire constitution of a gate selection circuit and an accumulating capacity driving circuit according to the first exemplary embodiment of the present invention will be described.

Figure 3:
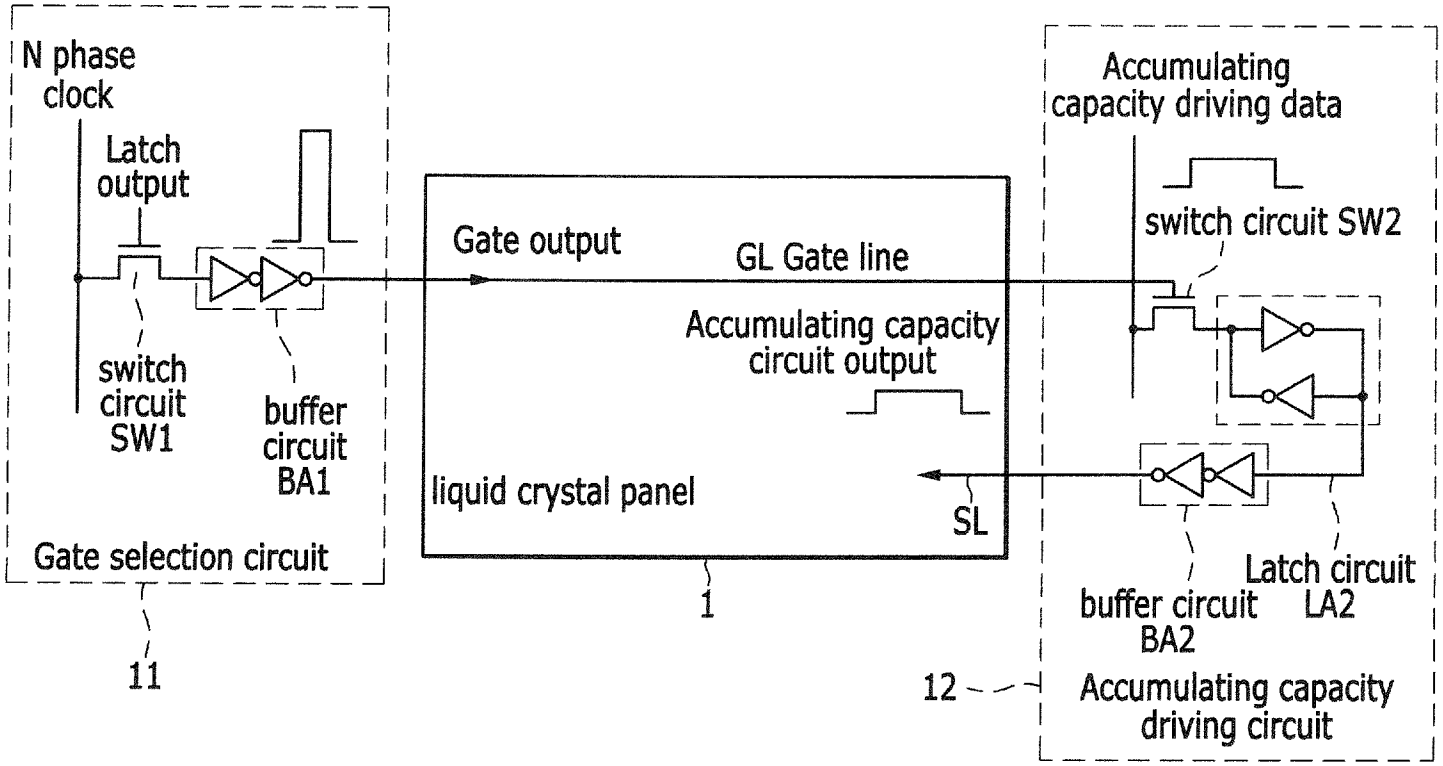
FIG. 3 is a view showing a relationship of a gate selection circuit and an accumulating capacity driving circuit of the present invention.

FIG. 3 is a view showing a relationship of a gate selection circuit and an accumulating capacity driving circuit of the present invention. That is, a relationship of the gate selection circuit disposed at the left side of a liquid crystal panel (a screen) and the accumulating capacity driving circuit disposed at the right side is shown in FIG. 3.

As shown in FIG. 3, the gate selection signal generated by the gate selection circuit 11 passes through the gate line GL of the liquid crystal panel 1, and accesses the switch circuit SW2 of the accumulating capacity driving circuit 12 at the opposite side.

Also, in the accumulating capacity driving circuit 12, at the time that the gate output (the gate selection signal) assumes the level H, the accumulating capacity driving data is set as the latch circuit LA2, and a predetermined data of the latch circuit LA2 is inputted to the buffer circuit BA2 and is outputted as an accumulating capacity circuit output.

In this case, as shown in FIG. 2, the accumulating capacity driving signal C<n+2> is generated by the gate selection signal Gate<n>. For the pixel to which the data signal is written by the gate selection signal Gate<n>, this is set up to delay the timing which is renewed by the accumulating capacity circuit output, and in this example, the offset by 2-lines is set. On the other hand, the line number for the offset may be appropriately selected.

Figure 15:
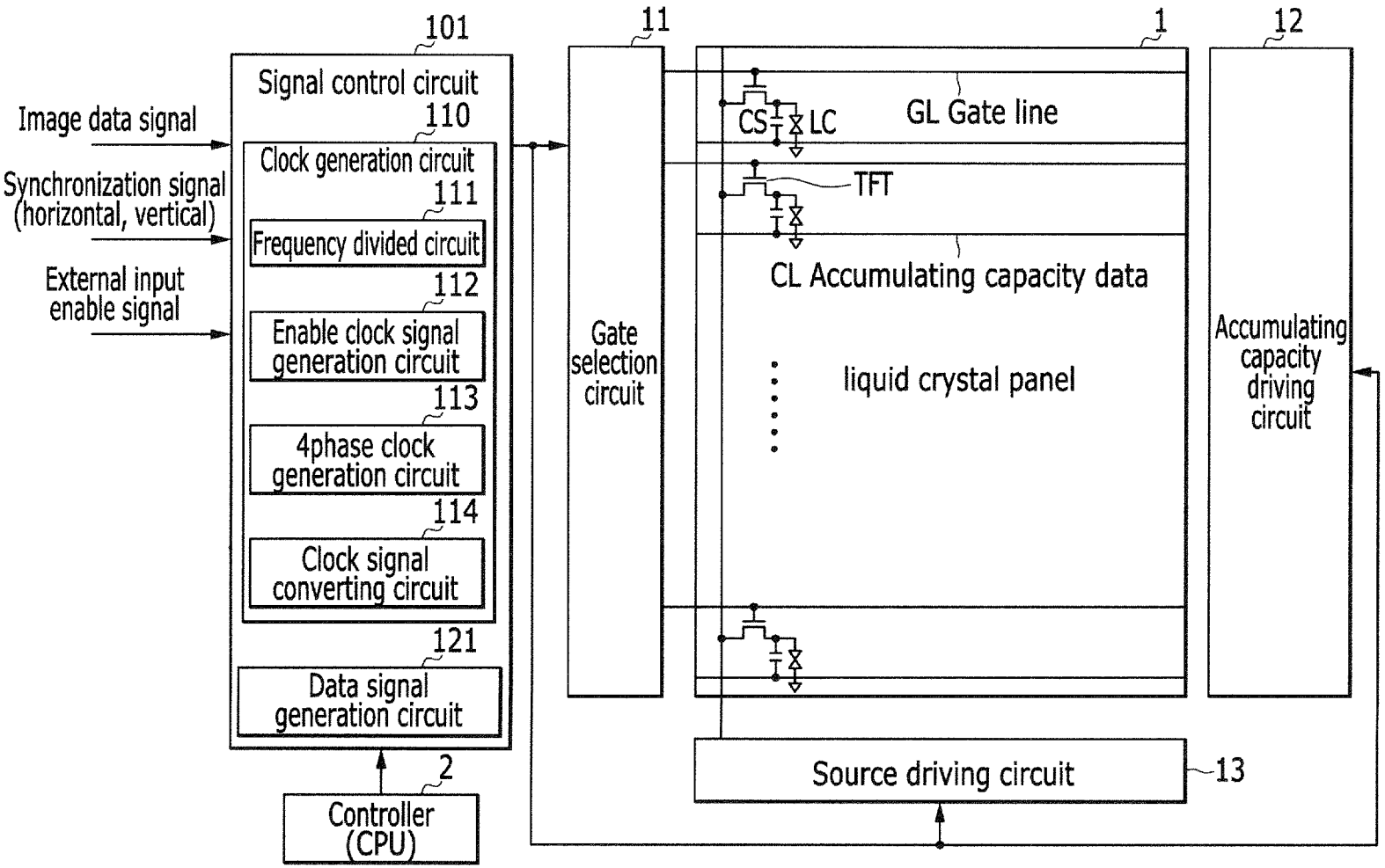
FIG. 15 is a view showing the constitution of a liquid crystal display using a driving apparatus of a liquid crystal panel of the present invention.

FIG. 15 is a view showing the constitution of a liquid crystal display using a driving apparatus (the gate selection circuit 11 and the accumulating capacity driving circuit 12) of a liquid crystal panel of the present invention.

In the liquid crystal display shown in FIG. 15, only a part directly related to the present invention, that is, a signal control circuit unit generating a signal such as the clock signal, is shown, and a counting electrode driving circuit, a backlight, a power supply circuit, etc. are omitted.

In the driving apparatus shown in FIG. 15, the liquid crystal panel 1 includes gate lines GL formed by arranging a plurality of electrodes in the horizontal direction, accumulating capacity lines CL formed by arranging a plurality of electrodes in the horizontal direction, and source lines SL formed by arranging a plurality of electrodes in the vertical direction.

Also, a pixel including a thin film transistor (TFT) switch, a liquid crystal capacitor LC, and an accumulating capacitor CS is formed at an intersection position of the gate line GL and the source line SL.

Also, the liquid crystal panel 1 is connected to a gate selection circuit 11 so as to drive the plurality of gate lines GL, an accumulating capacity driving circuit 12 so as to drive the plurality of accumulating capacity lines, and a source driving circuit 13 so as to drive the plurality of source electrodes.

For one scan period, the gate selection circuit 11 sequentially selects the thin film transistor (TFT) of the pixel connected to the gate line GL, and simultaneously writes the desired data voltage to the liquid crystal capacitor LC from the source driving circuit 13.

After writing the data voltage, by overlapping a predetermined voltage from the accumulating capacity driving circuit 12, the data written to the liquid crystal capacitor LC is converted into a voltage which is suitable for the optical characteristic of the actual liquid crystal, and is maintained to a next frame.

The signal control circuit unit 101 generates the signals to control the gate selection circuit 11, the accumulating capacity driving circuit 12, and the source driving circuit 13.

The signal control circuit unit 101 generates the signals to drive and control the gate selection circuit 11, the accumulating capacity driving circuit 12, and the source driving circuit 13 based on an image data signal, a synchronization signal (a horizontal•vertical synchronization signal), and an external input clock signal inputted from the outside under the control of the controller 2, including a central processing unit (CPU).

A clock generation circuit 110 in the signal control circuit unit 101 includes the frequency-divided circuit 111 for frequency-dividing a horizontal synchronization signal shown in FIG. 13, the enable clock signal generation circuit 112 for generating the enable clock signals Enable1 and Enable2, the 4-phase clock generation circuit 113 for generating the 4-phase clock signals CK1, CK2, CK3 and CK4, and the clock signal converting circuit 114 shown in FIG. 9.

A data signal generation circuit 121 generates and outputs the image signal of the source driving circuit 13 based on the image data signal.

Next, the operation of a gate selection circuit according to the first exemplary embodiment of the present invention will be described with reference to FIG. 4.

Figure 4:
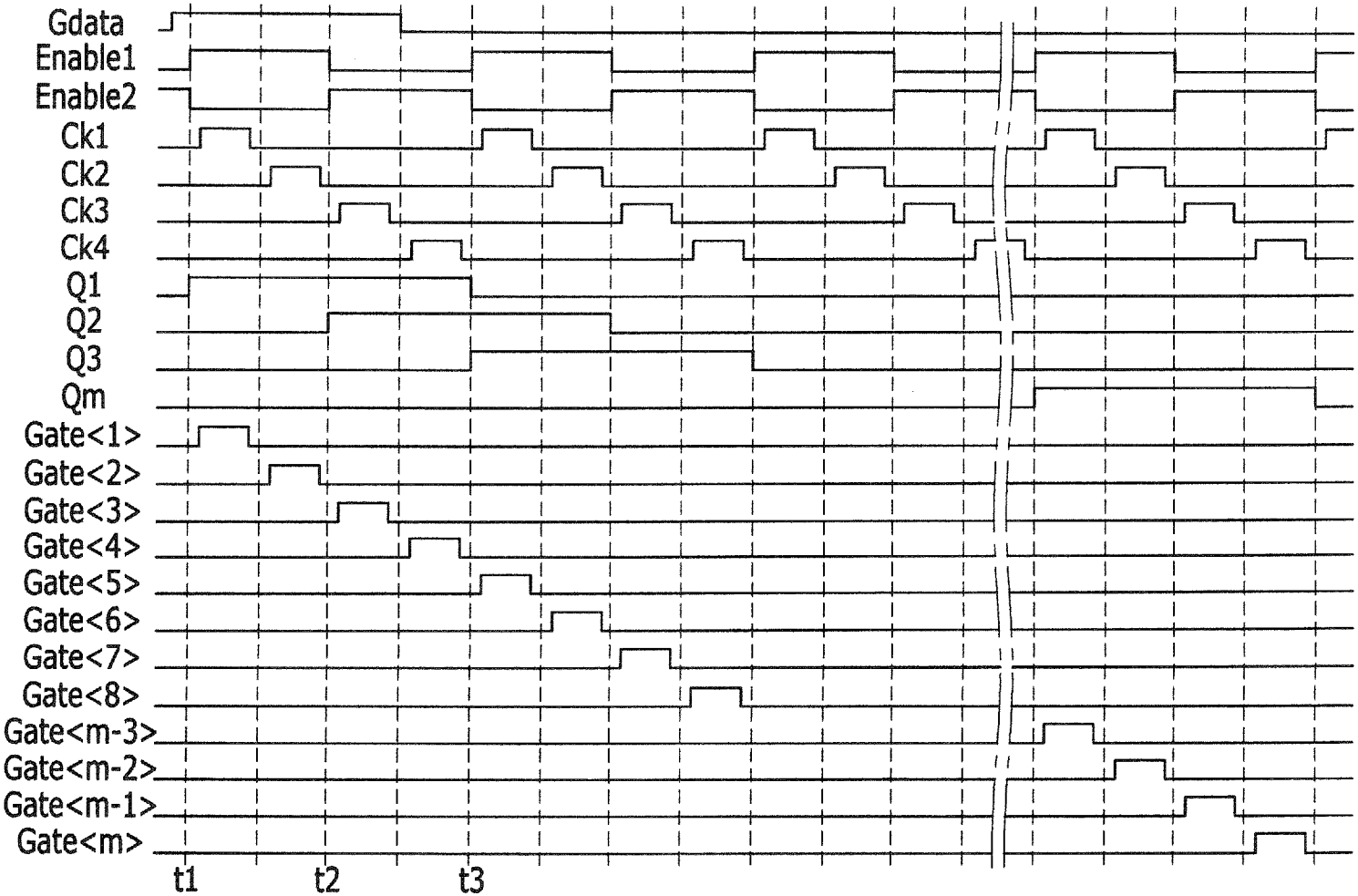
FIG. 4 is a view showing the operation of a gate selection circuit according to the first exemplary embodiment of the present invention.

FIG. 4 is a view showing the operation of a gate selection circuit according to the first exemplary embodiment of the present invention.

In FIG. 4, the horizontal axis represents time, and the vertical axis represents a data signal Gdata, enable clock signals Enable1 and Enable2, 4-phase clock signals CK1, CK2, CK3, and CK4, output signals Q1, Q2, Q3, and Qm of the latch circuit LA1, and gate selection signals Gate<1>, Gate<2>, Gate<3>, Gate<4>, . . . , Gate<m> inputted to the gate selection circuit 11.

In FIG. 4, if the data signal Gdata is input, a level H of the data signal Gdata is latched by the enable clock signals Enable1 and Enable2 so that the latch circuit output signals Q1, Q2, and Q3 are sequentially outputted at the times t1, t2, and t3.

The latch circuit outputs Q1 and Q2 access each switch circuit SW1 of FIG. 1, thereby being the enable signal to select the 4-phase clock signals CK1, CK2, CK3 and CK4.

For example, if Q1 assumes the H level, the switch circuit SW1 enters the ON state and the 4-phase clock signals CK1, CK2, CK3 and CK4 are all selected and sequentially outputted by passing through the gate line output terminals Gate<1>, Gate<2>, Gate<3>, Gate<4> . . . through the buffer circuit BA1 of FIG. 1.

The latch circuit LA1 constitutes a shift register circuit such that the switch circuit SW1 also enters the sequential ON state by transmission of the outputs Q1 and Q2, and it is possible to output each gate selection signal with desired timing.

Next, the operation of an accumulating capacity driving circuit according to the first exemplary embodiment of the present invention will be described with reference to FIG. 5.

Figure 5:
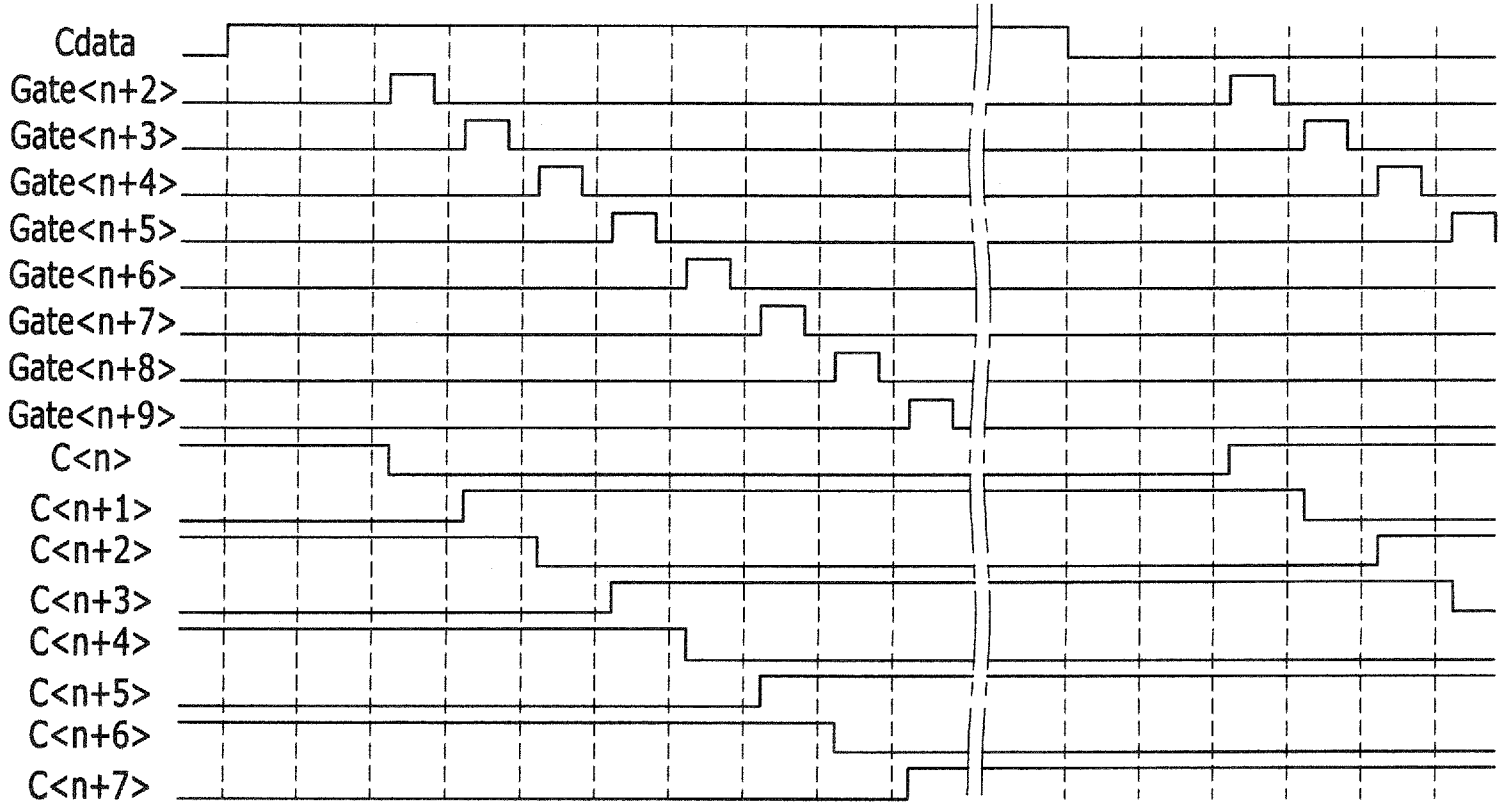
FIG. 5 is a view showing the operation of an accumulating capacity driving circuit according to the first exemplary embodiment of the present invention.

FIG. 5 is a view showing the operation of an accumulating capacity driving circuit according to the first exemplary embodiment of the present invention.

In FIG. 5, the horizontal axis represents time, and the vertical axis represents the data signal Cdata inputted to the accumulating capacity driving circuit 12, the gate selection signals Gate<n+2>, Gate<n+3>, Gate<n+4>, Gate<n+5>, Gate<n+6>, Gate<n+7>, Gate<n+8> and Gate<N+9> outputted from the gate selection circuit 11, and the accumulating capacity driving signals C<n>, C<n+1>, C<n+2>, C<n+3>, C<n+4>, C<n+5>, C<n+6> and C<n+7>.

In FIG. 5, if the gate selection signals Gate<n+2>, Gate<n+3>, . . . , Gate<n+9> from the gate selection circuit 11 of FIG. 1 are respectively inputted to each switch circuit SW2 of FIG. 2, the switch circuits SW2 SW2*n*+2-SW2*n*+9 in the accumulating capacity driving circuit 12 of FIG. 2 are sequentially turned on, and the accumulating capacity data Cdata is inputted to the latch circuits LA2 LA2*n*-LA2*n*+7.

Also, the outputs of the latch circuits LA2 LA2*n*-LA2*n*+7 are transmitted to the buffer circuits BA2 BA2*n*-BA2*n*+7 of FIG. 2, and are outputted to the accumulating capacity line output terminals C<n>, C<n+1>, . . . , C<n+7>.

On the other hand, the latch circuits LA2 LA2*n*-LA2*n*+7 maintain the value of the accumulating capacity data Cdata until the gate output (gate selection signal) from the gate selection circuit 11 is again inputted to the switch circuit SW2 in the next frame.

On the other hand, in the first exemplary embodiment of the present invention, the latch circuit LA2 of the accumulating capacity driving circuit 12 is realized by a bus-type latch circuit (referring to FIG. 20B) as described above.

The conventional accumulating capacity driving circuit includes the shift register constitution such that it is necessary for the latch circuit, as the shift register, to always supply the clock signal. Therefore, it is difficult for the accumulating capacity driving circuit to be made of a bus-type latch.

In contrast, in the accumulating capacity driving circuit 12 of the present invention, the timing for renewing the data of the latch is determined once in the first frame, that is, in the period in which the gate output of the gate selection circuit 11 becomes level H, such that it is not necessary to always renew the latch circuit LA1. Accordingly, it is possible to apply a small number of the bus-type latches to the accumulating capacity driving circuit 12.

As described above, the output signal of the latch circuit LA1, used to generate the conventional gate selection signal, is used as an enable signal for selecting a plurality of clock signals (for example, 4-phase clock signals). Accordingly, the gate selection circuit of the conventional art needs one latch circuit for one gate output. However, it is possible that two latch circuits may be used for four gate outputs to realize the same function in the gate selection circuit 11 of the present invention. As a result, the number of latch circuits LA1 of the gate selection circuit 11 may be reduced by half.

On the other hand, in the present exemplary embodiment, 4-phase clock signals as the plurality of clock signals are explained. However, the gate selection circuit 11 of the present invention may be applied to a clock signal other than the 4-phase clock signal by controlling the pulse width and the timing of the data signal Gdata and the enable clock signals Enable1 and Enable2 which are inputted to the latch circuit LA1.

For example, the pulse width of the data signal and the clock signal may be doubled (half frequency) and 8-phase clock signals may be inputted, and therefore it may be possible for the latch circuit LA1 for the gate selection circuit 11 to be constituted by two latch circuits for 8 gate outputs.

Equally, by inputting the N-phase clock signals into the gate selection circuit 11 of the present invention, the necessary latch circuits LA1 may be reduced to 2/N.

Also, in the accumulating capacity driving circuit 12 of the present invention, the number of latch circuits LA2 is one for one accumulating capacity driving circuit output without the change. However, the control signal to control the latch circuit LA2 may be reduced by using the gate output of the gate selection circuit 11 as the clock signal of the latch circuit LA2.

Furthermore, differently from the conventional latch, it is possible to reduce the number of circuit elements by applying a bus-type latch circuit, and the entire circuit area of the accumulating capacity driving circuit 2 may be reduced as compared with the conventional art.

As described above, the entire circuit area may be reduced by using the gate selection circuit 11 and the accumulating capacity driving circuit 12 of the present invention, and as a result, the size of a frame of the liquid crystal panel 1 of FIG. 3 may be reduced.

In the first exemplary embodiment, the gate selection circuit 11 and the accumulating capacity driving circuit 12 are separately installed. For example, as in FIG. 18, they are independently disposed at both sides of the liquid crystal panel 1. However, in the second exemplary embodiment, the gate selection circuit and the accumulating capacity driving circuit are combined into one, and an example in which two circuits are disposed at one side of the liquid crystal panel 1 is explained.

A driving apparatus of a liquid crystal panel according to the second exemplary embodiment of the present invention will be described with reference to FIG. 6.

Figure 6:
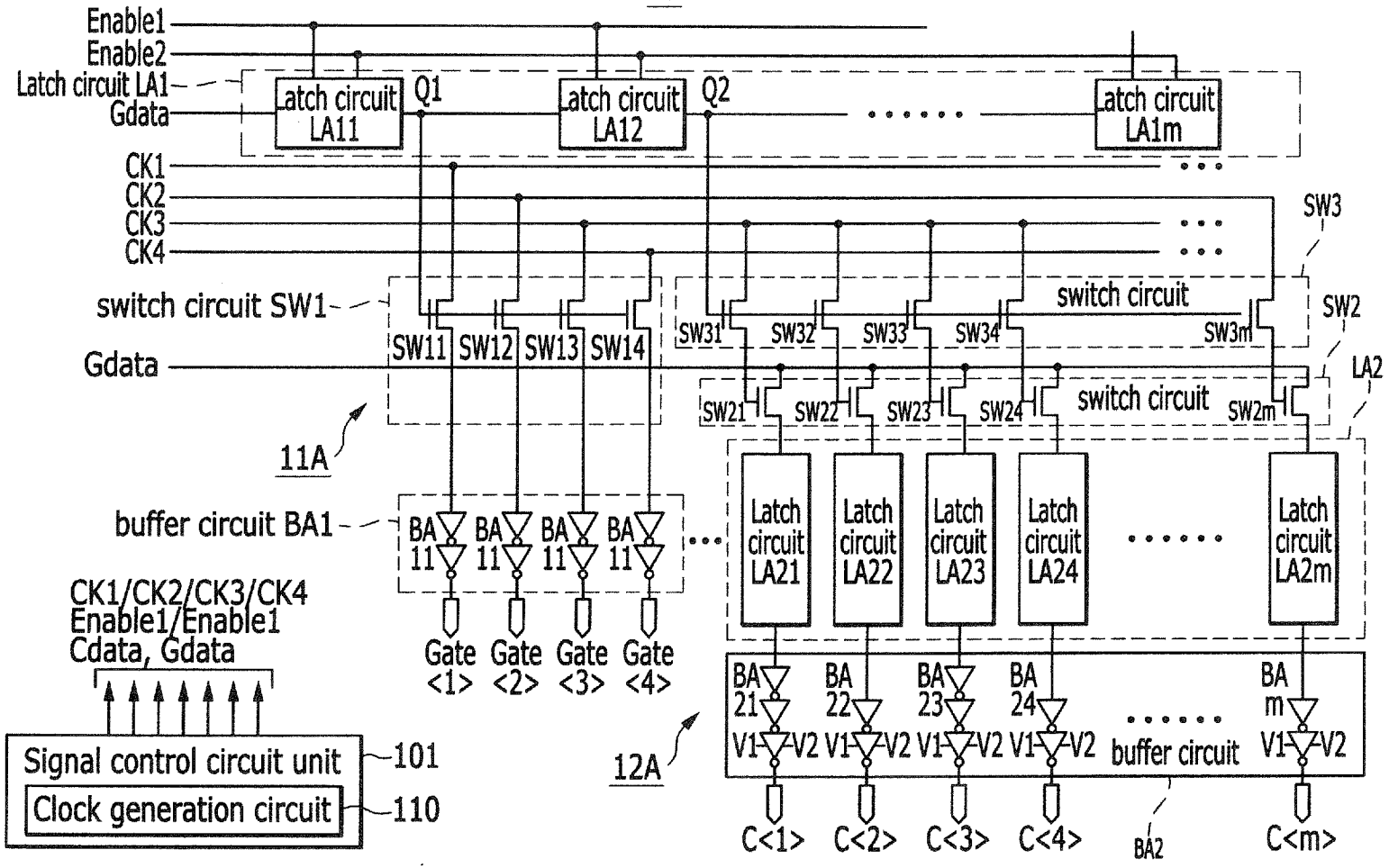
FIG. 6 is a view showing the constitution of a driving apparatus of a liquid crystal panel according to a second exemplary embodiment of the present invention.

FIG. 6 is a view showing the constitution of a driving apparatus of a liquid crystal panel according to a second exemplary embodiment of the present invention.

The driving apparatus 21 of FIG. 6 includes a gate selection circuit 11A and an accumulating capacity driving circuit 12A.

In the driving apparatus 21, the gate selection circuit 11A and the accumulating capacity driving circuit 12A are alternately disposed in correspondence to the latch circuit LA1.

The gate selection circuit 11A includes a shift register circuit (a latch circuit LA1) in which a plurality of latch circuits LA11-LA1*m* are connected in series, a switch circuit SW1 composed of a plurality of MOS transistors for selecting the desired gate signals from 4-phase clock signals CK1, CK2, CK3 and CK4, and a buffer circuit BA1 composed of a plurality of buffer circuits for outputting the gate selection signals Gate<1>, Gate<2>, Gate<3> and Gate<4>.

Also, the shift register circuit (the latch circuit LA1) receives as an input the enable clock signals Enable1 and Enable2 and the data signal Gdata, and the switch circuit SW1 is inputted with a plurality of clock signals (4-phase clock signals CK1, CK2, CK3 and CK4 in FIG. 6) outputted as the gate line signal.

The output of each buffer circuit in the buffer circuit BA1 is respectively connected to the gate line output terminals Gate<1>, Gate<2>, Gate<3>, Gate<4>, . . . , Gate<m>.

The constitution of the gate selection circuit 11A is the same as the gate selection circuit 11 of the first exemplary embodiment shown in FIG. 1 such that a detailed description is omitted.

Next, the accumulating capacity driving circuit 12A of FIG. 6 includes a switch circuit SW2, a switch circuit SW3, and a buffer circuit BA2.

The switch circuits SW2 and SW21-SW2*m* are switch circuits which are enabled by the clock signals CK1, CK2, CK3, and CK4 through the switch circuit SW3, and which select the accumulating capacity driving data signal Cdata, and this data is set up to the latch circuits LA2 and LA21-LA2*m*.

The gate of each switch circuit SW3 and SW31-SW3*m* is connected to the output side of the even numbered latch circuits LA12, LA14, . . . in the shift register circuit (the latch circuit LA1), selects the 4-phase clock signals CK1, CK2, CK3 and CK4, and is simultaneously the switch circuit for enabling the switch circuits SW2 and SW21-SW2*m*.

The buffer circuits BA2 and BA21-BA2*m* receive each output signal of the latch circuits LA2 and LA21-LA2*m*, and are buffer circuits for outputting each accumulating capacity signal.

Each output side of the plurality of buffer circuits BA21-BA2*m* is connected to a corresponding one of a plurality of accumulating capacity line output terminals C<1>, C<2>, C<3>, . . . , C<m>.

For the constitution of the accumulating capacity driving circuit 12A of FIG. 6, the description including the switch circuits SW2 and SW21-SW2*m*, the latch circuits LA2 and LA21-LA2*m*, and the buffer circuits BA2 and BA21-BA2*m* is the same as for the accumulating capacity driving circuit 12 shown in FIG. 2.

However, in contrast with the accumulating capacity driving circuit 12 of FIG. 2, the accumulating capacity driving circuit 12A shown in FIG. 6 uses the switch circuits SW3 and SW31-SW3*m*.

In other words, in the accumulating capacity driving circuit 12 shown in FIG. 2, the gate selection signals Gate<n+2>, Gate<n+3>, . . . , are used as the gate signals of each MOS transistor in the switch circuits SW2 and SW21-SW2*m*.

In contrast to this, in the accumulating capacity driving circuit 12A shown in FIG. 6, the switch circuits SW3 and SW31-SW3*m* generate the gate signal of the MOS transistors of the switch circuits SW2 and SW21-SW2*m* according to the output signals Q2, Q4, . . . of the even-numbered latch circuits LA12, LA 4, . . . in the latch circuits LA1 LA11-LA1*m* and the 4-phase clock signals CK1, CK2, CK3 and CK4.

In this case, each switch of the switch circuit SW3 and SW31-SW3*m* is divided into four units and generates the gate signal of the switch circuit SW2.

For example, four switch circuits SW31-SW34 generate the gate signal of the switch circuits SW21-24 by the output signal Q2 of the latch circuit LA12 and the clock signals CK1, CK2, CK3 and CK4. By the same method, four switch circuits SW35-SW38 generate the gate signal of the switch circuits SW25-28 by the output signal Q4 of the latch circuit LA14 and the clock signals CK1, CK2, CK3 and CK4.

Next, the operation of the gate selection circuit 11A and the accumulating capacity driving circuit 12A according to the second exemplary embodiment of the present invention will be described with reference to FIG. 7.

Figure 7:
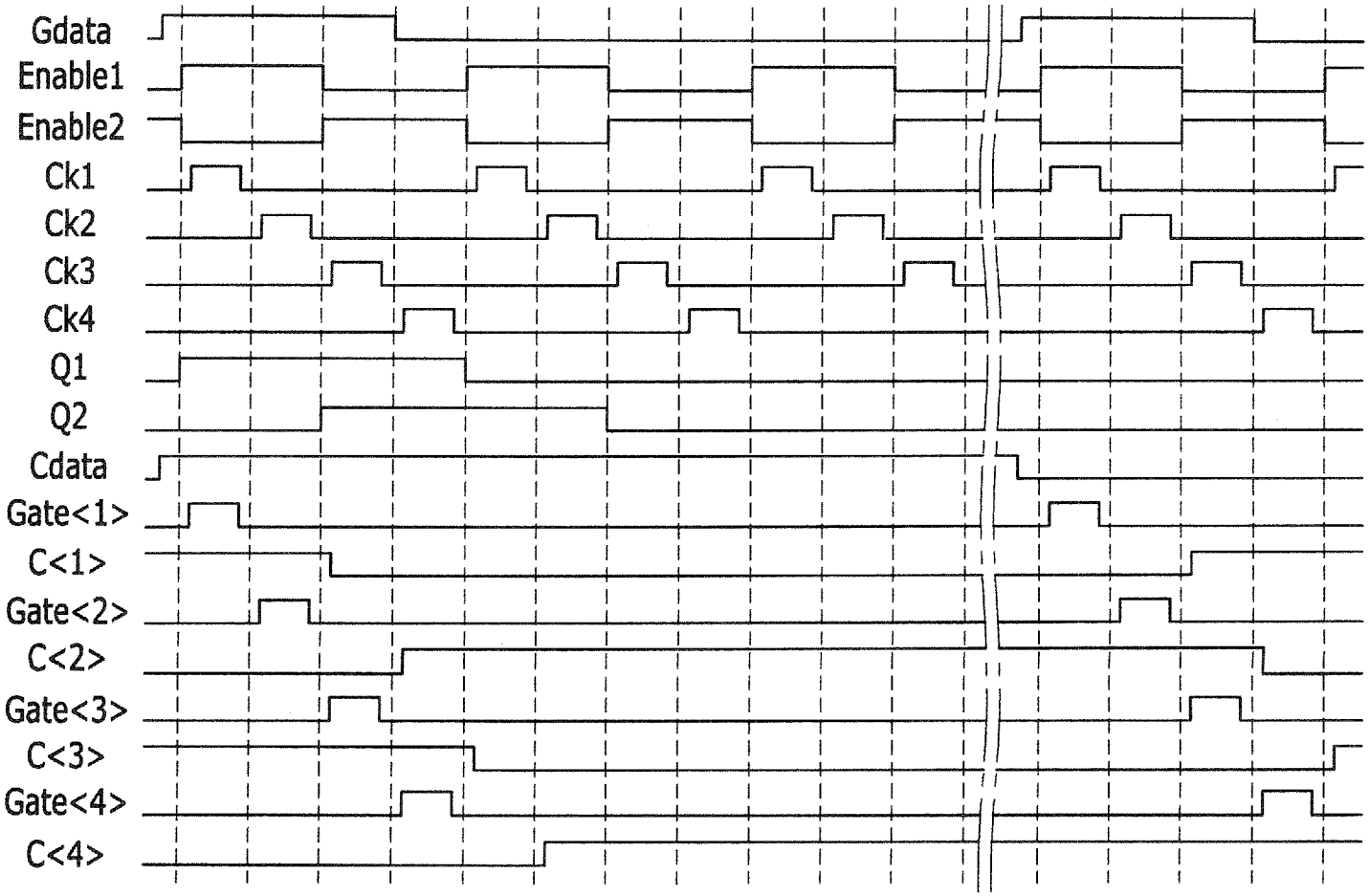
FIG. 7 is a view showing the operation of a gate selection circuit and an accumulating capacity driving circuit according to the second exemplary embodiment of the present invention.

FIG. 7 is a view showing the operation of a gate selection circuit and an accumulating capacity driving circuit according to the second exemplary embodiment of the present invention.

Here, the gate selection circuit is the same as that of the first exemplary embodiment and is not described in further detail.

In FIG. 7, the horizontal axis represents time, and the vertical axis represents the data signal Gdata, the enable clock signals Enable1 and Enable2, the clock signals CK1, CK2, CK3 and CK4, the output signal Q1 of the latch circuit LA11, the output signal Q2 of the latch circuit LA12, the data signal Cdata, the gate selection signal Gate<1>, the accumulating capacity driving signal C<1>, the gate selection signal Gate<2>, the accumulating capacity driving signal C<2>, the gate selection signal Gate<3>, the accumulating capacity driving signal C<3>, the gate selection signal Gate<4>, and the accumulating capacity driving signal C<4>.

Also, as shown in FIG. 7, if the output Q2 of the latch circuit LA12 assumes the level H in the shift register circuit in the operation of the accumulating capacity driving circuit 12A, the switch circuits SW3 and SW31-SW34 enter the ON state, and the switch circuits SW2 and SW21-SW24 are enabled by the 4-phase clock signals CK1, CK2, CK3 and CK4 at a predetermined time.

The switch circuits SW2 and SW21-SW24 enter the ON state, and the accumulating capacity data Cdata is inputted to the latch circuits LA2 and LA21-LA24.

Also, the output of each of the latch circuits LA2 and LA21-LA24 is transmitted to the buffer circuits BA2 and BA21-BA24, and is outputted to the accumulating capacity line output terminals C<1>, C<2>, C<3> and C<4>.

On the other hand, the latch circuits LA2 and LA21-LA24 continuously maintain the value of the accumulating capacity data Cdata until the switch circuits SW2 and SW21-SW24 are enabled in the next frame.

Furthermore, for the latch circuit LA2 of the accumulating capacity driving circuit 12A according to the second exemplary embodiment of the present invention, a bus-type latch circuit (referring to FIG. 20B) including two inverter circuits is applied.

In the first exemplary embodiment, the timing with which the data of the latch circuit LA2 is renewed is the period in which the gate output of the gate selection circuit 11 becomes the level H. However, the output Q2 of the latch circuit LA12 of the gate selection circuit 11A assumes the level H and the 4-phase clock signals CK1, CK2, CK3 and CK4 assume the level H in the second exemplary embodiment. Obtaining of the same effect as the first exemplary embodiment is clear by viewing the waveform diagram shown in FIG. 7.

In the second exemplary embodiment of the present invention, the output signal of the latch circuit LA1 is used as the enable signal to select a plurality of clock signals to generate the gate selection signals, and thereby 0.5 latch circuits for one gate output (two latch circuits for the four gate outputs) may provide the same function in the gate selection circuit 11A of the present invention. The second exemplary embodiment obtains the same effect as the first exemplary embodiment.

In the accumulating capacity driving circuit 12A, the number of latch circuits required for one accumulating capacity driving circuit output is one without the change, and the output signals Q2, Q4, . . . of the latch circuit LA1 which are previously provided in the gate selection circuit 11A and the 4-phase clock signals CK1, CK2, CK3 and CK4 are used for the control of the latch circuit LA2 such that a control signal for controlling the accumulating capacity driving circuit 12A is not separately needed.

In contrast to the conventional latch circuit, the number of circuit elements may be reduced by applying the bus-type latch circuit, and the entire circuit area may be reduced for the accumulating capacity driving circuit 12A.

As described above, the entire circuit area may be reduced by using the gate selection circuit 11A and the accumulating capacity driving circuit 12A of the second embodiment of the present invention while maintaining the same function as the conventional art, and as a result, the size of a frame of the liquid crystal panel 1 may be reduced.

Figure 8:
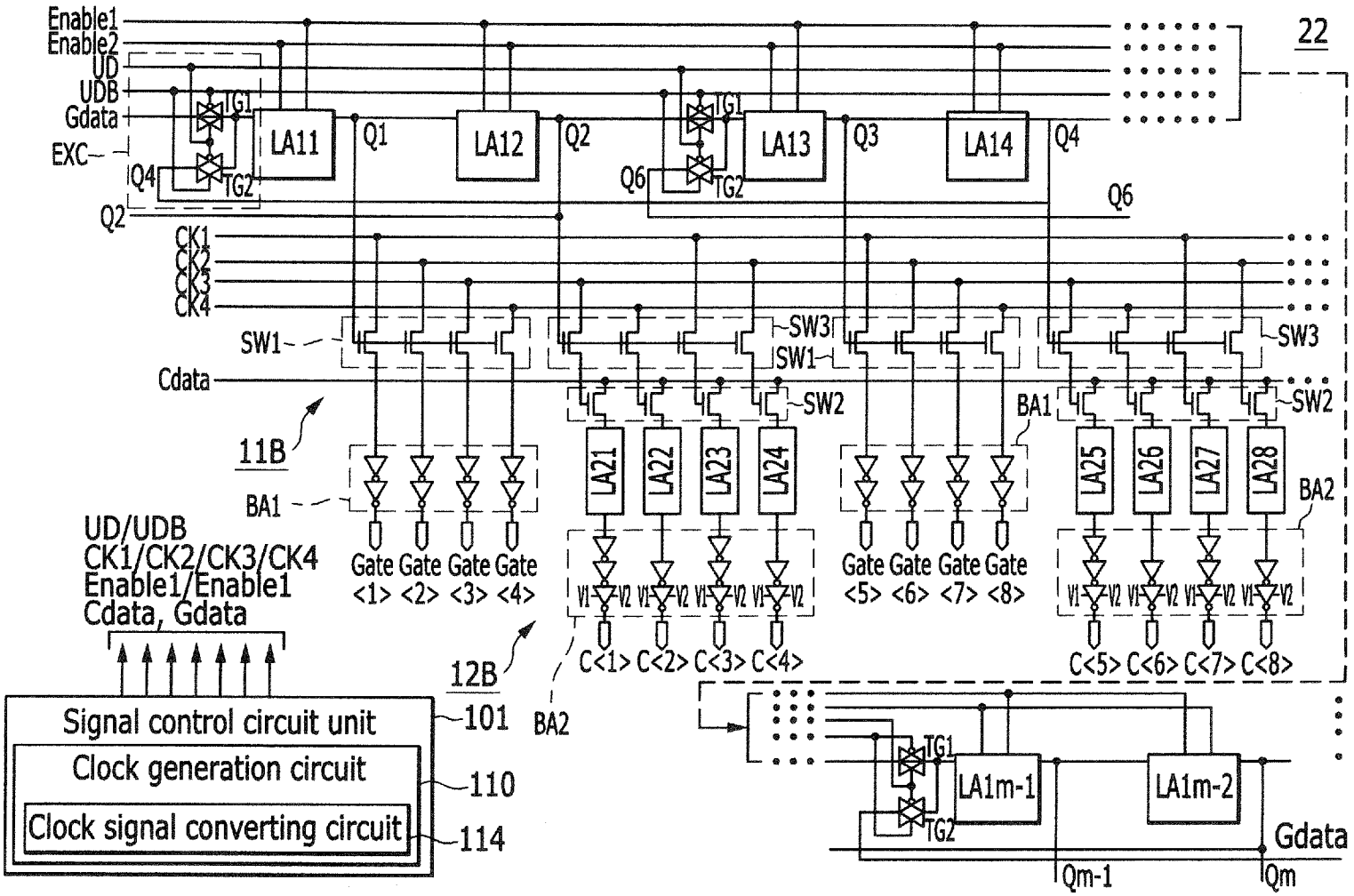
FIG. 8 is a view showing the constitution of a driving apparatus of a liquid crystal panel according to a third exemplary embodiment of the present invention.

FIG. 8 is a view showing the constitution of a driving apparatus of a liquid crystal panel according to a third exemplary embodiment of the present invention.

A driving apparatus of a liquid crystal panel related to the third exemplary embodiment of the present invention will be described with reference to FIG. 8.

The driving apparatus 22 of the third exemplary embodiment shown in FIG. 8 includes a gate selection circuit 11B and an accumulating capacity driving circuit 12B.

The gate selection circuit 11B includes latch circuits LA1 and LA11-LA1*m*, a switch circuit SW1, and a buffer circuit BA1.

On the other hand, the signal control circuit unit 101 having the clock generation circuit 110 is included, and is referred to as the gate selection circuit.

Also, the accumulating capacity driving circuit 12B includes the switch circuits SW2 and SW3, the latch circuit LA2, and the buffer circuit BA2.

In contrast to the driving apparatus 21 of the second exemplary embodiment shown in FIG. 6, the driving apparatus 22 of the third exemplary embodiment shown in FIG. 8 further includes a bi-direction converting circuit EXC (a portion enclosed by a broken line) including transfer gates TG 1 and TG2 at the input side of the latch circuit LA1 (including LA11, LA13, . . . , LA1*m*-1), and the rest of the constitution is the same as the circuit shown in FIG. 6.

In the gate selection circuit 11B and the accumulating capacity driving circuit 12B shown in FIG. 8, the data signal inputted to the latch circuits LA 11, LA 13, . . . , LA1*m*-1 (the odd-numbered latch circuits) is selected, and a bi-direction converting circuit EXC, including two transfer gates TG1 and TG2 to determine a transmission direction of the shift register and control signals UD and UDB to control the bi-direction converting circuit EXC, is added.

As described above, the constitution shown in FIG. 8 is the same as the constitution adding the bi-direction converting circuit EXC to the gate selection circuit 11A according to the second exemplary embodiment shown in FIG. 6, and thereby a similar constitution is indicated by a like reference number and the overlapping description is omitted.

Figure 9A:
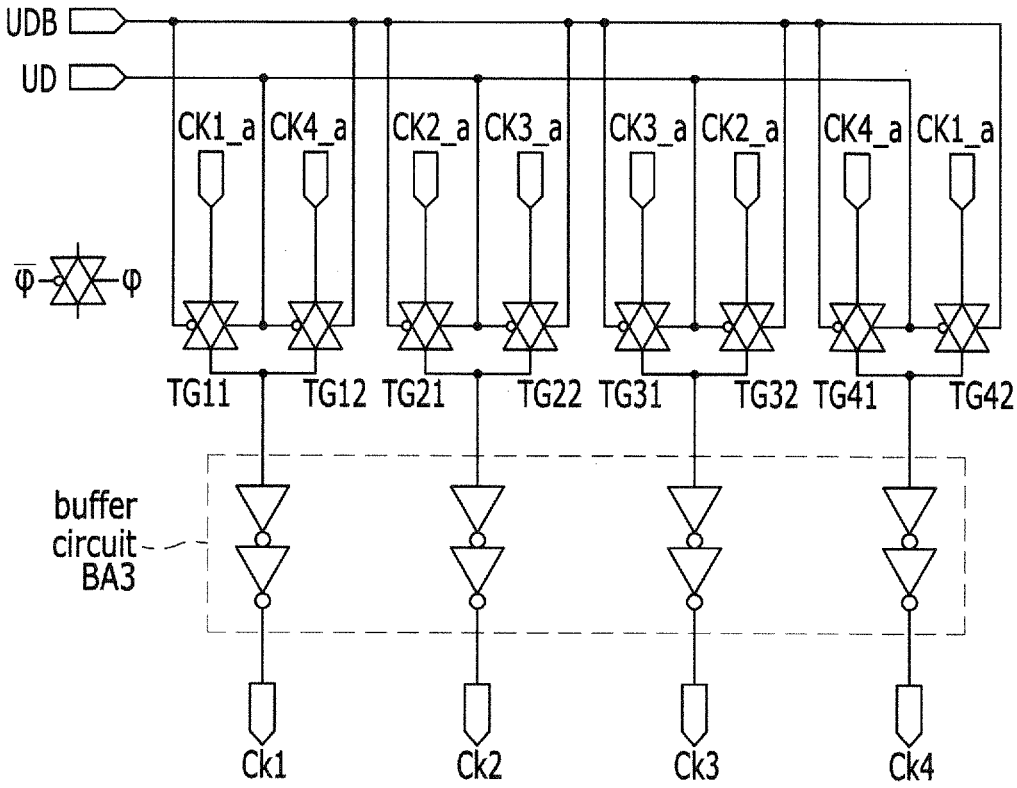
FIGS. 9A and 9B are views showing an example of a clock signal converting circuit.
Figure 9B:
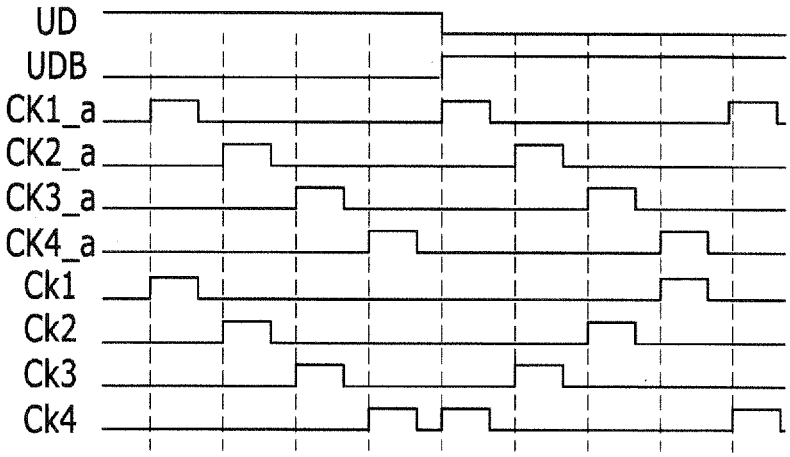

FIGS. 9A and 9B are views showing an example of a clock signal converting circuit.

Specifically, FIG. 9A is a view showing a clock signal converting circuit 114. To realize the bi-direction transmission of the shift register circuit LA11-LA1*m* shown in FIG. 8, the clock signal converting circuit 114 is synchronized with the state of the control signals UD and UDB, and is a circuit which inverts the phase of the 4-phase clock signal.

This clock signal converting circuit 114 is installed in the clock generation circuit 110 of the signal control circuit unit 101, as shown in FIG. 15.

As shown in FIG. 9A, in the clock signal converting circuit 114, the transfer gate TG11 and the transfer gate TG12 are commonly connected at the output side, the clock signal CK1_*a* is inputted to the input side of the transfer gate TG11, the control terminal ϕ is inputted with the signal UDB, and the control terminal ϕ is inputted with the signal UD.

Also, the input side of the transfer gate TG12 is inputted with the clock signal CK4_*a*, the control terminal ϕ is inputted with the signal UD, and the control terminal ϕ is inputted with the signal UDB.

One of the signal clock signal CK1_*a* and the clock signal CK4_*a* is selected and outputted to the output side to which the transfer gates TG11 and TG12 are commonly connected according to the signal level of the signals UD and UDB.

The selected signal is outputted as the clock signal CK1 through the buffer circuit BA3.

The transfer gates TG21 and TG22, the output sides of which are commonly connected, select and output one of the clock signal CK2_*a* and the clock signal CK3_*a* according to the signal level of the signals UD and UDB, as in the transfer gates TG11 and TG12, and the selected signal is outputted as the clock signal CK2 through the buffer circuit BA3.

By the same method, the transfer gates TG31 and TG32, the output sides of which are commonly connected, select and output one of the clock signal CK3_*a* and the clock signal Ck2_*a* according to the signal level of the signals UD and UDB, and the selected signal is outputted as the clock signal CK3 through the buffer circuit BA3.

Finally, the transfer gates TG41 and TG42, the output sides of which are commonly connected select and output one of the clock signal CK4_*a* and the clock signal CK1_*a* according to the signal level of the signals UD and UDB, and the selected signal is outputted as the clock signal CK4 through the buffer circuit BA3.

By the clock signal converting circuit, as shown in FIG. 9B, in the state in to which the signal UD is at the level H and the signal UDB is at the level L, the clock signals CK1, CK2, CK3 and CK4 are outputted according to the phase sequence of the input clock signals CK1_a, CK2_a, CK3_a and CK4_a.

On the other hand, in the state in which the signal UD is at the level L and the signal UDB is at the level H, the clock signals CK1, CK2, CK3 and CK4 having a phase, wherein the phase sequence of the input clock signals CK1_a, CK2_a, CK3_a and CK4_a is inverted, are outputted.

An operation of the gate selection circuit according to the third exemplary embodiment of the present invention will be described with reference to FIG. 10.

Figure 10:
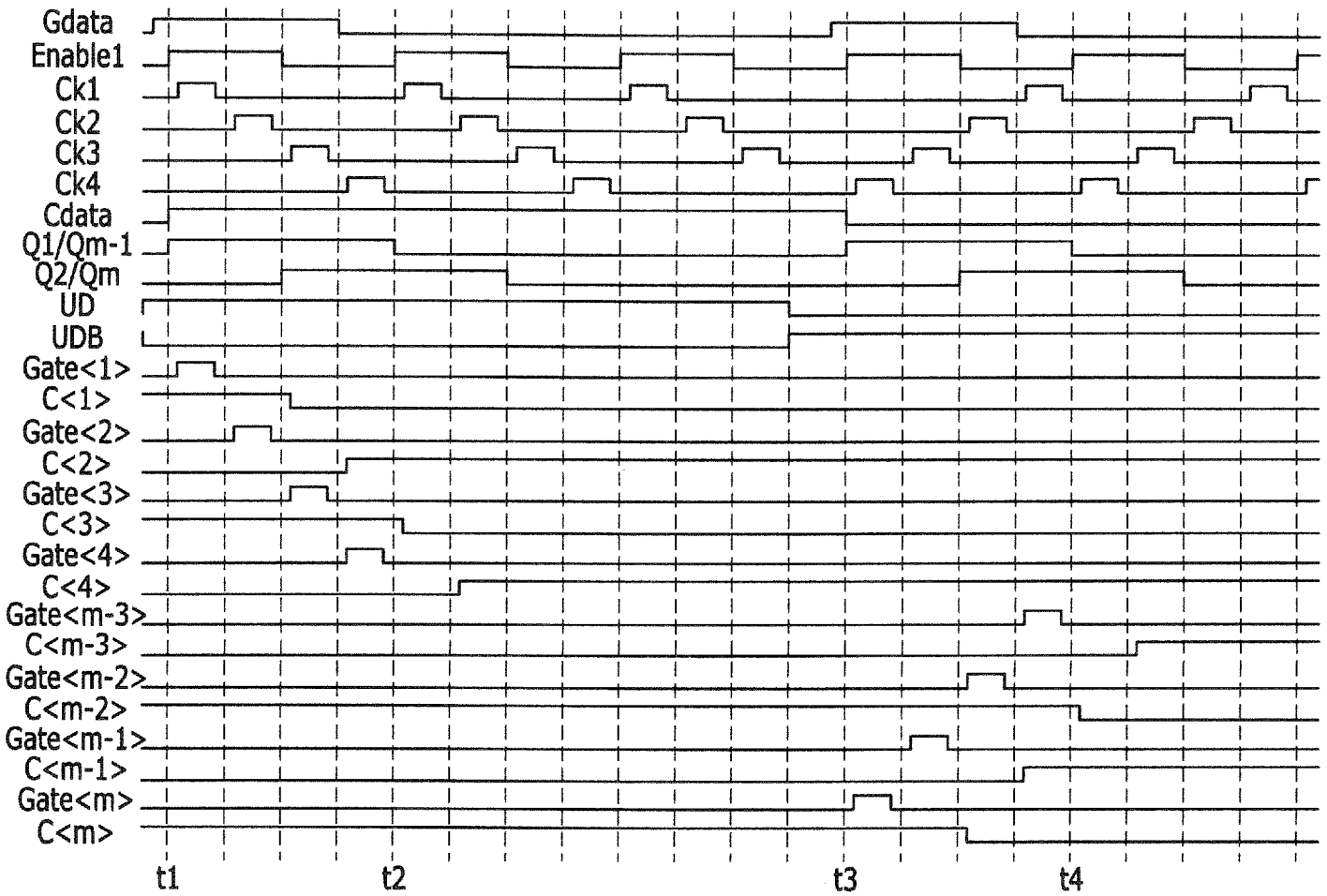
FIG. 10 is a view showing the operation of a gate selection circuit and an accumulating capacity driving circuit according to the third exemplary embodiment of the present invention.

FIG. 10 is a view showing the operation of a gate selection circuit and an accumulating capacity driving circuit according to the third exemplary embodiment of the present invention.

In the timing chart shown in FIG. 10, the horizontal axis represents time, and the vertical axis represents the data signal Gdata inputted to the latch circuit LA1, the enable clock signal Enable1, the clock signals CK1, CK2, CK3 and CK4, the data signal Cdata inputted to the accumulating capacity driving circuit 12B, the output signal Q1 of the latch circuit LA11 or the output signal Qm-1 of the latch circuit LA1*m*-1, the output signal Q2 of the latch circuit LA21 or the output signal Qm of the latch circuit LA1*m*, the signal UD and the signal UDB, the gate selection signal Gate<1>, the accumulating capacity driving signal C<1>, the gate selection signal Gate<2>, the accumulating capacity driving signal C<2>, the gate selection signal Gate<3>, the accumulating capacity driving signal C<3>, the gate selection signal Gate<4>, the accumulating capacity driving signal C<4>, the gate selection signal Gate<m-3>, the accumulating capacity driving signal C<m-3>, the gate selection signal Gate<m-2>, the accumulating capacity driving signal C<m-2>, the gate selection signal Gate<m-1>, the accumulating capacity driving signal C<m-1>, the gate selection signal Gate<m>, and the accumulating capacity driving signal C<m>.

As shown in FIG. 10, the bi-direction converting circuit EXC of FIG. 8 includes a function for converting the transmission direction of the shift register circuit (the latch circuits LA1 LA11-LA1*m*).

In other words, when the transmission direction of the gate selection circuit 11B is the same as Gate<1>, Gate<2>, Gate<3>, Gate<4>, . . . , Gate<8> . . . , the signal UD is at the level H ⌈UD=H⌋ and the signal UDB is at the level L, ⌈UDB=L⌋, TG1 and TG2 of the bi-direction converting circuit EXC are respectively in the ON state and the OFF state, and the signal data Gdata is inputted to the latch circuit LA11 of the left end shown in FIG. 8.

Also, data like the output signal Q1, Q2, Q3, Q4, . . . are sequentially transmitted in synchronization with the enable clock signals Enable1 and Enable2.

For example, in the period t1-t2, the gate selection signals are outputted in the sequence of the gate selection signals Gate<1>, Gate<2>, Gate<3> and Gate<4>.

In contrast, when the transmission direction of the gate selection circuit 11B is the same as Gate<8>, . . . , Gate<4>, Gate<3>, Gate<2> and Gate<1>, the signal UD is at the level L ⌈UD=L⌋ and the signal UDB is at the level H ⌈UDB=H⌋. Thus, TG2 and TG1 of the bi-direction converting circuit EXC are respectively in the ON state and the OFF state, the signal data Gdata is inputted to the second latch circuit LA1*m*-1 from the right end, and the sequential data are transmitted with the sequence of the sequential Qm-1, Qm, . . . in synchronization with the enable clock signals Enable1 and Enable2.

For example, in the period t3-t4, the gate selection signals are outputted with the sequence of the gate selection signals Gate<m>, Gate<m-1>, Gate<m-2> and Gate<m-3>.

The operation until the gate selection signal is outputted from each latch output is the same as in the first exemplary embodiment, and the second exemplary embodiment.

Also, the operation of the accumulating capacity driving circuit 12B according to the third exemplary embodiment of the present invention is the same as in the second exemplary embodiment such that a detailed description is omitted.

As described above, in the third exemplary embodiment it is possible to convert the transmission direction of the gate selection circuit 11B and the accumulating capacity driving circuit 12B, as well as the function of the second exemplary embodiment.

Also, the latch circuit LA1 is used as the enable signal to select a plurality of clock signals to generate the gate selection signals, and in the gate selection circuit of the present invention, 0.5 latch circuits are required for one gate output (two latch circuits for four gate outputs) to realize the same function, and thereby the same effect as in the first exemplary embodiment and the second exemplary embodiment may be obtained.

In the accumulating capacity driving circuit 12B, the number of latch circuits required for one accumulating capacity driving circuit output is one without the change. However, the output signals Q2, Q4, . . . of the latch circuit, which are previously provided in the gate selection, circuit and the 4-phase clock signals CK1, CK2, CK3 and CK4, are used for the control of the latch circuit LA2 such that it is not necessary to separately provide a control signal for controlling the accumulating capacity driving circuit 12B.

Furthermore, by applying the bus type latch circuit from the conventional latch circuit, the reduction of the number of circuit elements is possible, and the reduction of the entire circuit area is possible for the accumulating capacity driving circuit 12B.

As described above, by using the gate selection circuit 11B and the accumulating capacity driving circuit 12B according to the third exemplary embodiment of the present invention, while maintaining the same function as the conventional circuit, the reduction of the entire circuit area is possible, and as a result, the size of the frame of the liquid crystal panel is reduced.

The constitution of the driving apparatus of the liquid crystal panel according to the fourth exemplary embodiment of the present invention will be described with reference to FIG. 11.

Figure 11:
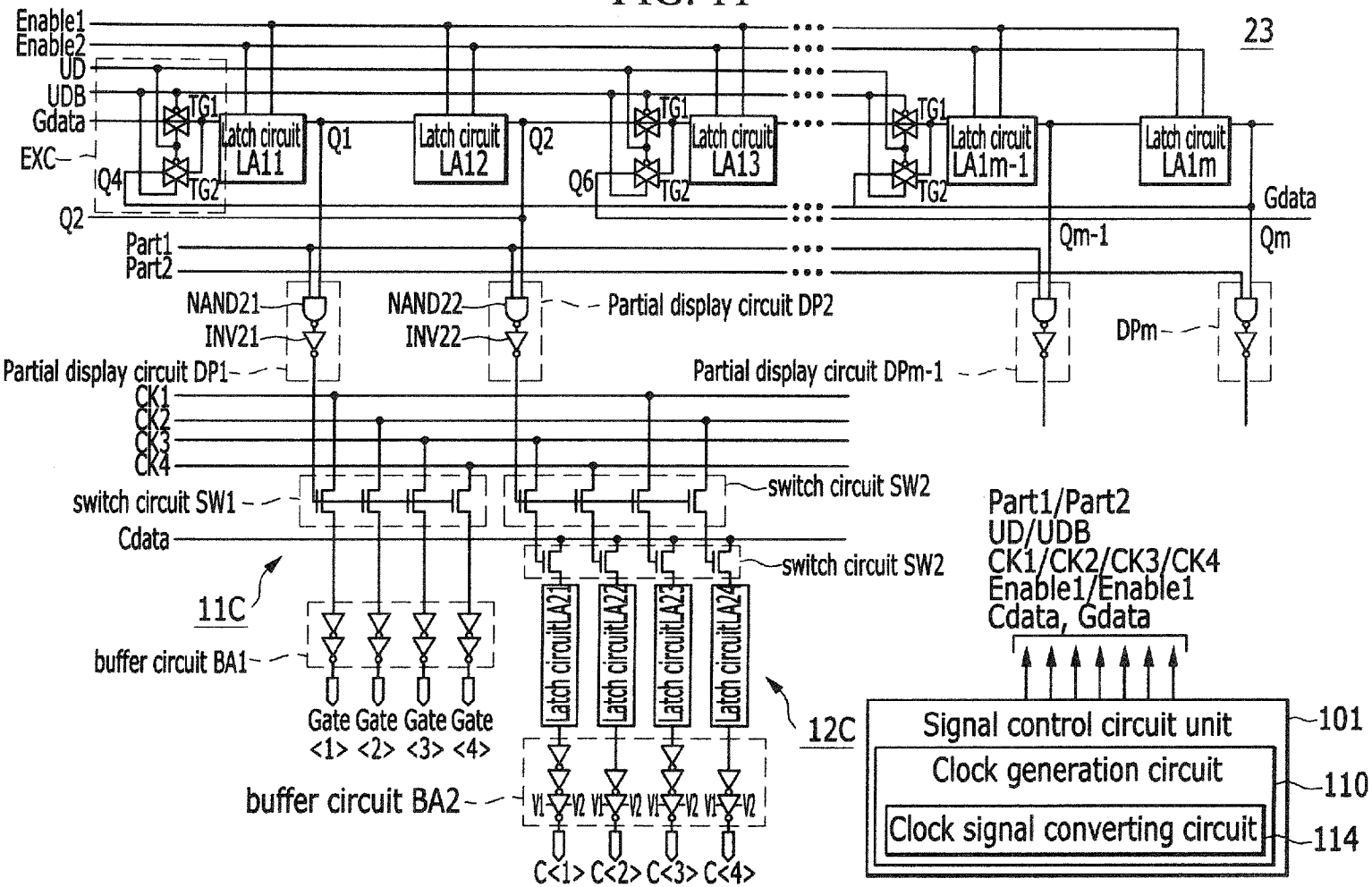
FIG. 11 is a view showing the constitution of a driving apparatus of a liquid crystal panel according to a fourth exemplary embodiment of the present invention.

FIG. 11 is a view showing the constitution of a driving apparatus of a liquid crystal panel according to a fourth exemplary embodiment of the present invention.

The driving apparatus 23 of the fourth exemplary embodiment shown in FIG. 11 includes a gate selection circuit 11C and an accumulating capacity driving circuit 12C.

The gate selection circuit 11C includes the latch circuits LA1 and LA11-LA1*m*, the bi-direction converting circuit EXC, the partial display circuit DP1, the switch circuit SW1, and the buffer circuit BA1. On the other hand, the signal control circuit unit 101 receiving the clock generation circuit 110 may be included, and may be referred to as the gate selection circuit.

Also, the accumulating capacity driving circuit 12C includes the partial display circuit DP2, the switch circuit SW2, the switch circuit SW3, the latch circuit LA2, and the buffer circuit BA2.

In the driving apparatus 23 shown in FIG. 11, the gate selection circuit 11C and the accumulating capacity driving circuit 12C are alternately disposed in correspondence to the latch circuit LA1.

Differently from the gate selection circuit 11B and the accumulating capacity driving circuit 12B according to the third exemplary embodiment shown in FIG. 8, the gate selection circuit 11C and the accumulating capacity driving circuit 12C according to the fourth exemplary embodiment shown in FIG. 11 include partial display circuits DP1-DPm which are added to the circuit of FIG. 8, and the rest of the configuration is the same as the third exemplary embodiment shown in FIG. 8.

In other words, the circuit configuration of the fourth exemplary embodiment of the present invention is the same as the configuration of the third exemplary embodiment but with the addition of the partial display circuits DP1-DPm to the gate selection circuit and the accumulating capacity driving circuit of the third exemplary embodiment of the present invention. Therefore, the with respect to the common configuration shown in FIG. 8, the overlapping description is omitted.

In FIG. 11, the odd-numbered partial display circuits DP1, DP3, . . . are configured by connecting NAND circuits and the inverter circuits in series.

Also, for example, for the partial display circuit DP1, one input terminal of the NAND circuit NAND21 is inputted with the signal Part1, and the other input terminal is inputted with the output signal Q1 of the latch circuit LA11.

The output signal of the NAND circuit NAND21 is inputted to the switch circuit SW1 through the inverter circuit INV21, and the output of the inverter circuit INV21 is applied to the common gate signal of each MOS transistor in the switch circuit SW1.

Furthermore, the even-numbered partial display circuits DP2, DP4, . . . are constituted by connecting the NAND circuit and the inverter circuit in series.

In addition, for example, for the partial display circuit DP2, one input terminal of the NAND circuit NAND22 is inputted with the signal Part2, and the other input terminal is inputted with the output signal Q2 of the latch circuit LA12.

The output signal of the NAND circuit NAND22 is inputted to the switch circuit SW3 through the inverter circuit INV22, and the output of the inverter circuit INV22 is applied to the common gate signal of each MOS transistor in the switch circuit SW3.

The operation of the gate selection circuit of the fourth exemplary embodiment will be described with reference to FIG. 12.

Figure 12:
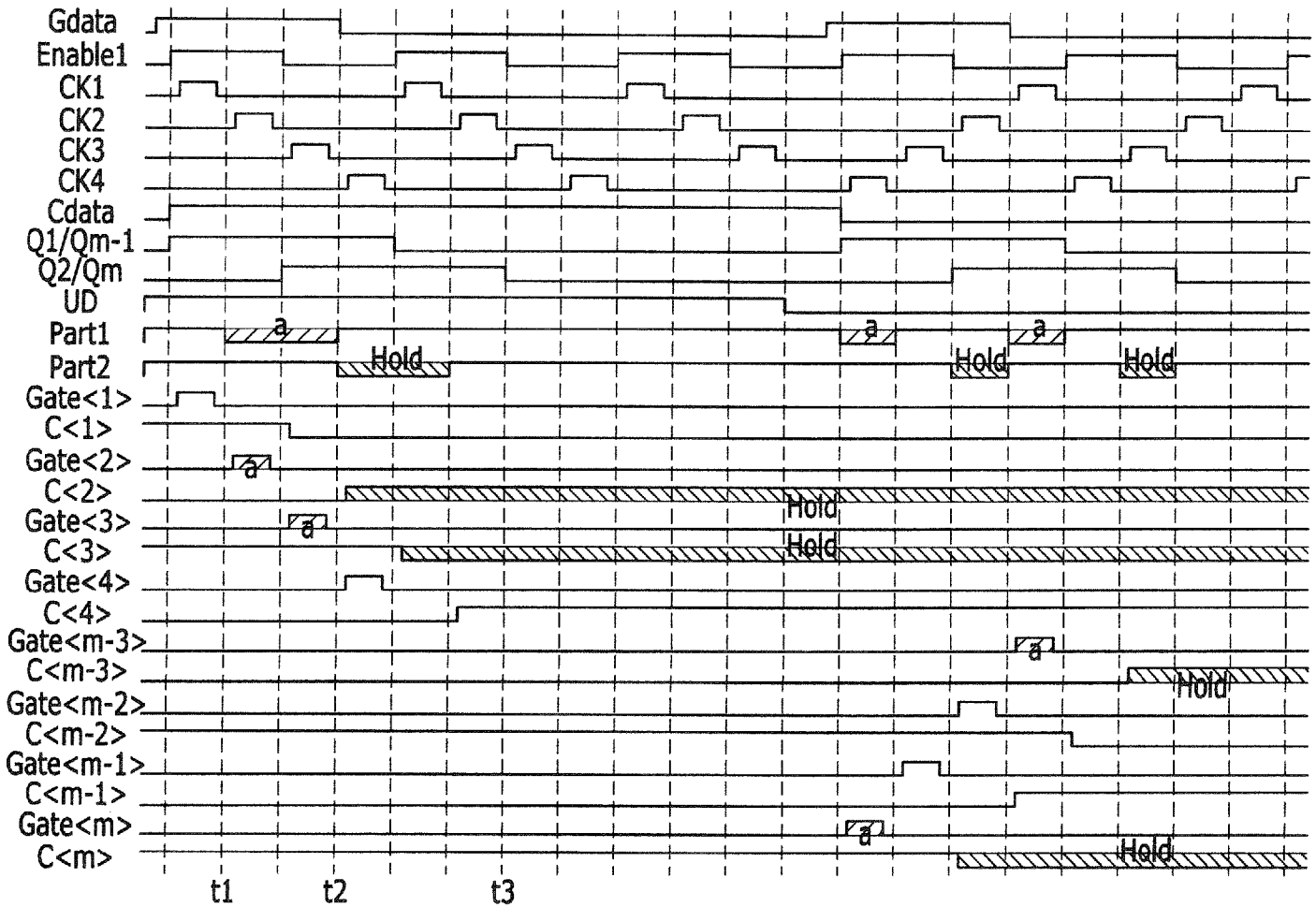
FIG. 12 is a timing chart showing the operation according to the fourth exemplary embodiment of the present invention.

FIG. 12 is a timing chart showing the operation according to the fourth exemplary embodiment of the present invention.

In the timing chart shown in FIG. 12, the horizontal axis represents time, and vertical axis direction represents the data signal Gdata inputted to the latch circuit LA1, the enable clock signal Enable1, the clock signals CK1, CK2, CK3 and CK4, the data signal Cdata inputted to the accumulating capacity driving circuit, the output signal Q1 of the latch circuit LA11 or the output signal Qm-1 of the latch circuit LA1*m*-1, the output signal Q2 of the latch circuit LA12 or the output signal of the Qm latch circuit LA1*m*, the signal UD, the signals Part1 and Part2, the gate selection signal Gate<1>, the accumulating capacity driving signal C<1>, the gate selection signal Gate<2>, the accumulating capacity driving signal C<2>, the gate selection signal Gate<3>, the accumulating capacity driving signal C<3>, the gate selection signal Gate<4>, the accumulating capacity driving signal C<4>, the gate selection signal Gate<m-3>, the accumulating capacity driving signal C<m-3>, the gate selection signal Gate<m-2>, the accumulating capacity driving signal C<m-2>, the gate selection signal Gate<m-1>, the accumulating capacity driving signal C<m-1>, the gate selection signal Gate<m>, and the accumulating capacity driving signal C<m>.

The operation relating to the converting of the transmission direction of the shift register is the same as in the third exemplary embodiment such that the detailed description thereof is omitted, and the operation relating to the function of the partial display circuit DP1 and the partial display circuit DP2 will be described.

When the signal Part1 shown in FIG. 12 is at the level H, the switch circuit SW1 which is enabled by the output signal Q1 of the latch circuit LA11 enters the ON state, and the 4-phase clock signals CK1, CK2, CK3 and CK4 are outputted as the predetermined gate selection signals.

In contrast, when the signal Part1 is at the level L, the gate selection circuit 11C enters the OFF state, and the gate selection signals Gate<1>, Gate<2>, Gate<3> and Gate<4> are not outputted.

The timing represented by the slashed portion of the reference numeral a of FIG. 12 is referred to.

In the period t1-t2, by the level L of the signal Part1, the gate selection signals Gate<2> and Gate<3> (the slashed portion indicated by the reference numeral a) are not outputted.

It is possible for the state of the switch circuit to control every gate line according to the logic of the signal Part1, and only the desired gate line may be selected for the output.

This function is needed in order to partially display the liquid crystal panel, and is realized by the fourth exemplary embodiment of the present invention.

For the accumulating capacity driving circuit 12C, it is also possible to only renew the data of the desired accumulating capacity output by the partial display circuit DP2.

The timing represented by the slashed portion indicated by the reference numeral Hold of FIG. 12 is referred to.

In the period t2-t3, by the signal Part2 of the level L, the accumulating capacity driving signals C<2> and C<3> are not changed, and become the Hold (the portion indicated by the reference numeral Hold).

On the other hand, in the accumulating capacity driving circuit 12C, the output state is maintained by the latch circuit LA2, and thereby the latch data of the latch circuit LA2 which is not renewed by the partial display is also included in the next frame.

As described above, the fourth exemplary embodiment adds the function of the partial display to the function of the third exemplary embodiment.

The output signal of the latch circuit LA1 used to generate the gate selection signal is used as the enable signal to select the plurality of clock signals, and thereby the gate selection circuit of the present invention may provide the same function as the conventional art if there is 0.5 latch circuits per one gate output (two latch circuit for four gate outputs). Accordingly, the same effect as the first, second, and third exemplary embodiments is obtained.

Also, for the accumulating capacity driving circuit 12C, as in the previous exemplary embodiment, it is not necessary to separately prepare the control signal to control the accumulating capacity driving circuit 12C.

Also, by applying the bus-type latch circuit from the conventional latch circuit, the reduction of the number of circuit elements is possible, and the reduction of the entire circuit area is possible for the accumulating capacity driving circuit 12C.

As described above, by using the gate selection circuit 11C and the accumulating capacity driving circuit 12C according to the fourth exemplary embodiment of the present invention, while maintaining the same function as the conventional circuit, the reduction of the entire circuit area is possible, and as a result, the size of the frame of the liquid crystal panel is reduced.

As described above, in the present invention, for the gate selection circuit of the electric optical device (the active matrix liquid crystal panel) using a portable information terminal, the clock generation circuit generating the plurality of clock signals of at least 4-phase and the enable clock signals, a plurality of latch circuits controlled by the enable clock signals Enable1 and Enable2 generated by the clock generation circuit and executing the operation of the shift register, and the switch circuit which enters the enable state by the output signal of the latch circuit are provided.

The plurality of clock signals generated by the clock generation circuit are constituted so as to be sequentially outputted as the gate selection signals by the output signal of the latch circuit, and thereby the entire circuit size of the gate selection circuit may be reduced.

Also, for the accumulating capacity driving circuit to drive the accumulating capacity of the pixel circuit of the liquid crystal panel, by using the gate selection signal output as the enable signal for the latch circuit in the accumulating capacity driving circuit, the control signal for the driving of the accumulating capacity driving circuit is reduced.

Also, the bus-type latch circuit is applied to the latch circuit of the accumulating capacity driving circuit such that the entire circuit area may be reduced.

The corresponding relationship of the present invention and the exemplary embodiment will now be subsidiarily described.

The driving apparatus of the liquid crystal panel of the present invention includes the gate selection circuit and the accumulating capacity driving circuit.

Also, the driving apparatus of the liquid crystal panel of the present invention corresponds to the driving apparatuses 21, 22 and 23.

Furthermore, the gate selection circuit of the present invention corresponds to the gate selection circuits 11, 11A, 11B and 11C, and the accumulating capacity driving circuit of the present invention corresponds to the accumulating capacity driving circuits 12, 12A, 12B and 12C.

On the other hand, the gate selection circuits 11, 11A, 11B and 11C may include the clock generation circuit 110 shown in FIG. 15.

Also, the clock generation circuit of the present invention corresponds to the clock generation circuit 110 (referring to FIG. 15).

The first latch circuit of the present invention corresponds to the latch circuits LA1 LA11-LA1*n*, and the second latch circuit corresponds to the latch circuits LA2 LA21-LA2*m*.

In the present invention, the first switch circuit corresponds to the switch circuit SW1 (SW11-SW1*m* etc.), the second switch circuit corresponds to the switch circuit SW2 (SW21-SW2*m* etc.), and the third switch circuit corresponds to the switch circuit SW3 (SW31-SW3*m* etc.).

In the present invention, the bi-direction converting circuit corresponds to the bi-direction converting circuit EXC (referring to FIG. 8), the first partial display circuit corresponds to the partial display circuit DP1(referring to FIG. 11), and the second partial display circuit corresponds to the partial display circuit DP2.

The enable clock signal of the present invention corresponds to the enable clock signals Enable1 and Enable2, and plurality of clock signals correspond to the 4-phase clock signals CK1, CK2, CK3 and CK4.

The data maintained as the first latch circuit LA1 corresponds to the data signal Gdata, the data set up as the second latch circuit LA2 corresponds to the data signal Cdata, the first partial display control signal corresponds to the signal Part1 (referring to FIG. 11), and the second partial display control signal corresponds to the signal Part2 (referring to FIG. 11).

In the exemplary embodiment, the clock generation circuit 110 in the gate selection circuit 11 generates the enable clock signals Enable1 and Enable2 generated by frequency-dividing a predetermined horizontal synchronization signal synchronized with the image signal displayed in the liquid crystal panel 1 and the plurality of clock signals CK1, CK2, CK3 and CK4 generated from a predetermined vertical synchronization clock signal and the enable clock signals Enable1 and Enable2 and having different phases.

A plurality of the first latch circuits LA1 are connected in series, thereby forming the shift register and shifting the hold information Gdata in synchronization with the enable clock signals Enable1 and Enable2.

The first switch circuit SW1 is installed in correspondence to the gate line GL, and each gate line GL is supplied with the clock signals CK1, CK2, CK3 and CK4 as the gate selection signals of the pixel. The first switch circuit SW1 sequentially outputs the gate selection signals according to the output signal output from the first latch circuit LA1.

Accordingly, a plurality of clock signals CK1, CK2, CK3 and CK4 generated by the clock generation circuit 110, by the output signal from the latch circuit LA1, are sequentially outputted as the gate selection signals from the switch circuit SW1, and thereby the gate selection circuit reducing the circuit size of the latch circuit LA1 may be provided.

For the above exemplary embodiment, the accumulating capacity driving circuit 12 includes a plurality of the second latch circuits LA2 for driving the accumulating capacity included in the pixel, and the second switch circuit SW2 transmits the information maintained by the accumulating capacitor CS to the second latch circuit LA2 according to the gate selection signal output from the gate selection circuit 11.

Accordingly, by using the gate selection signal output from the gate selection circuit 11, it is possible that the control signal for controlling the second latch circuit LA2 may be reduced.

The second latch circuit may be constituted by the bus-type latch circuit including two inverter circuits, and thereby the reduction of the entire circuit area for the accumulating capacity driving circuit is possible.

The driving apparatus according to the liquid crystal panel according to the exemplary embodiment includes the gate selection circuit 11 and the accumulating capacity driving circuit 12.

The gate selection circuit 11 includes a plurality of the first latch circuits LA1 forming the shift registers which are arranged in series and which shift the hold information in synchronization with the enable clock signals Enable1 and Enable2 and the first switch circuit SW1 installed in correspondence to the gate line GL, and sequentially outputting the gate selection signal according to the output signal outputted from the first latch circuit LA1 when the clock signals CK1, CK2, CK3 and CK4 corresponding to each gate line GL are supplied as the gate selection signals of the pixel.

The accumulating capacity driving circuit includes a plurality of the second latch circuits LA2 for driving the accumulating capacitor CS included in the pixel, and the second switch circuit SW2 for transmitting the information (the data signal Cdata) maintained by the accumulating capacitor CS to the second latch circuit LA2 according to the gate selection signal outputted from the gate selection circuit 11.

As described above, the driving apparatus for the liquid crystal panel uses the gate selection circuit and the accumulating capacity driving circuit, and thereby it is possible for the circuit number of the latch circuit and the entire circuit area to be reduced, and as a result, the size of the frame of the liquid crystal panel may be reduced.

In the driving apparatus 21 (referring to FIG. 6) for the liquid crystal panel, the third switch circuit SW3 inputs a plurality of clock signals CK1, CK2, CK3 and CK4, and simultaneously enters the enable state by the output signal of the first latch circuit LA1.

In the enable state, the clock signals CK1, CK2, CK3 and CK4 are outputted to the second switch circuit SW2, and thereby the second switch circuit SW2 enters the enable state.

In the driving apparatus 21, in a predetermined period of the enable state by the output signal of the first latch circuit LA1, a plurality of clock signals CK1, CK2, CK3 and CK4 are sequentially outputted as the output signals of the gate selection circuit through the first switch circuit SW1. Simultaneously, in the predetermined period of the enable state by the output signal of the first latch circuit LA1, through the second switch circuit SW2 and the third switch circuit SW3, the information for maintaining the accumulating capacitor CS for the second latch circuit LA2 is set up.

Accordingly, by using the gate selection circuit and the accumulating capacity driving circuit of the present invention for the driving apparatus for the liquid crystal panel, while maintaining the same function as the conventional circuit, the entire circuit area may be reduced, and as a result the size of the frame of the liquid crystal panel may be reduced.

The driving apparatus 22 (referring to FIG. 8) for the liquid crystal panel includes the bi-direction converting circuit EXC for selecting the input information inputted to the first latch circuit LA1 and for selecting the direction in which the hold information is shifted, and the clock signal converting circuit 114 for converting the phase sequence of the plurality of clock signals supplied to the first switch circuit SW1 and the second switch circuit SW2.

Accordingly, it is possible for the transmission direction of the gate selection circuit 11B and the accumulating capacity driving circuit 12B to be converted.

The gate selection circuit 11C of the driving apparatus 23 (referring to FIG. 11) for the liquid crystal panel includes the first partial display circuit DP1, the output of which is determined by the output signal from the first latch circuit LA1 and the first partial display control signal Part1, and the first switch circuit SW1 connected to a plurality of clock signals CK1, CK2, CK3 and CK4 and enabled by the output signal from the first partial display circuit DP1.

The accumulating capacity driving circuit 12C includes the second partial display circuit DP2, the output of which is determined by the output signal from the first latch circuit LA1 and the second partial display control signal Part2, and the third switch circuit SW3 connected to a plurality of clock signals CK1, CK2, CK3 and CK4 and simultaneously enabled by the output signal from the second partial display circuit DP2, enabling the second switch circuit SW2 by outputting the clock signals CK1, CK2, CK3 and CK4 in the above enabled state.

In the predetermined period of the enable state by the output signal of the first partial display circuit DP1, for the plurality of clock signals CK1, CK2, CK3 and CK4, only the selected predetermined gate selection signal is sequentially outputted as the output signal of the gate selection circuit 11C. The information maintained by the accumulating capacitor CS, in the predetermined period of the enable state by the output signal of the first latch circuit LA1, is selectively renewed by selectively enabling the second switch circuit SW2 and the third switch circuit SW3 by the output signal of the second partial display circuit DP2. The output sequence of the output signal for the gate selection circuit 11C and the accumulating capacity driving circuit 12C is inverted according to the bi-direction converting circuit EXC and the clock signal converting circuit 114.

Therefore, the entire circuit area may be reduced, and as a result, the size of the frame of the liquid crystal panel may be reduced, and furthermore, the function of the partial display may be added.

Figure 16:
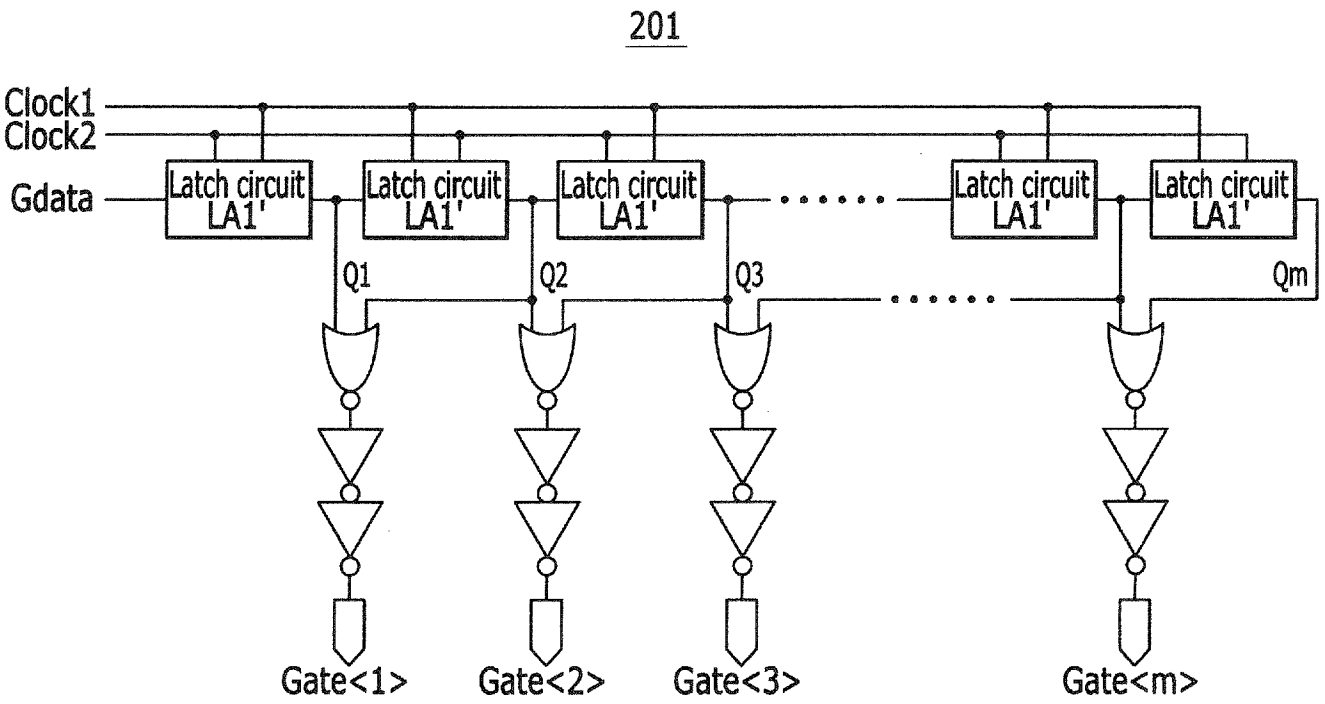
FIG. 16 is a view showing the constitution of a gate selection circuit.
Figure 17:
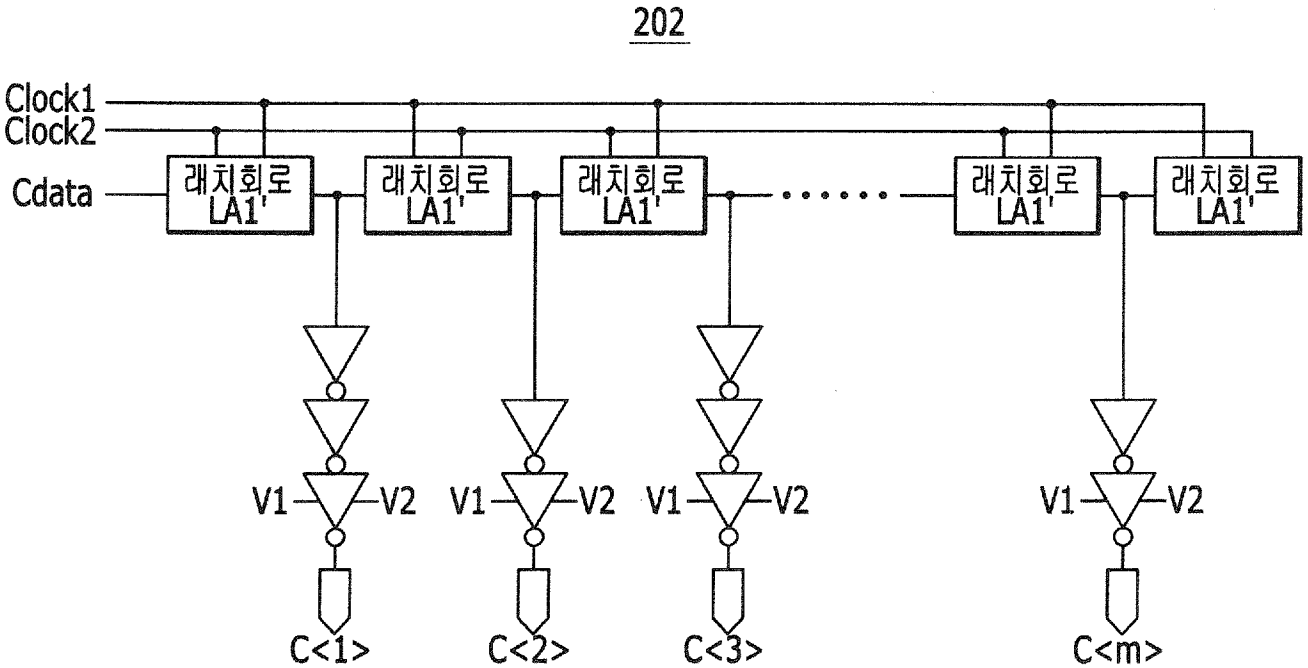
FIG. 17 is a view showing the constitution of an accumulating capacity driving circuit.
Figure 18:
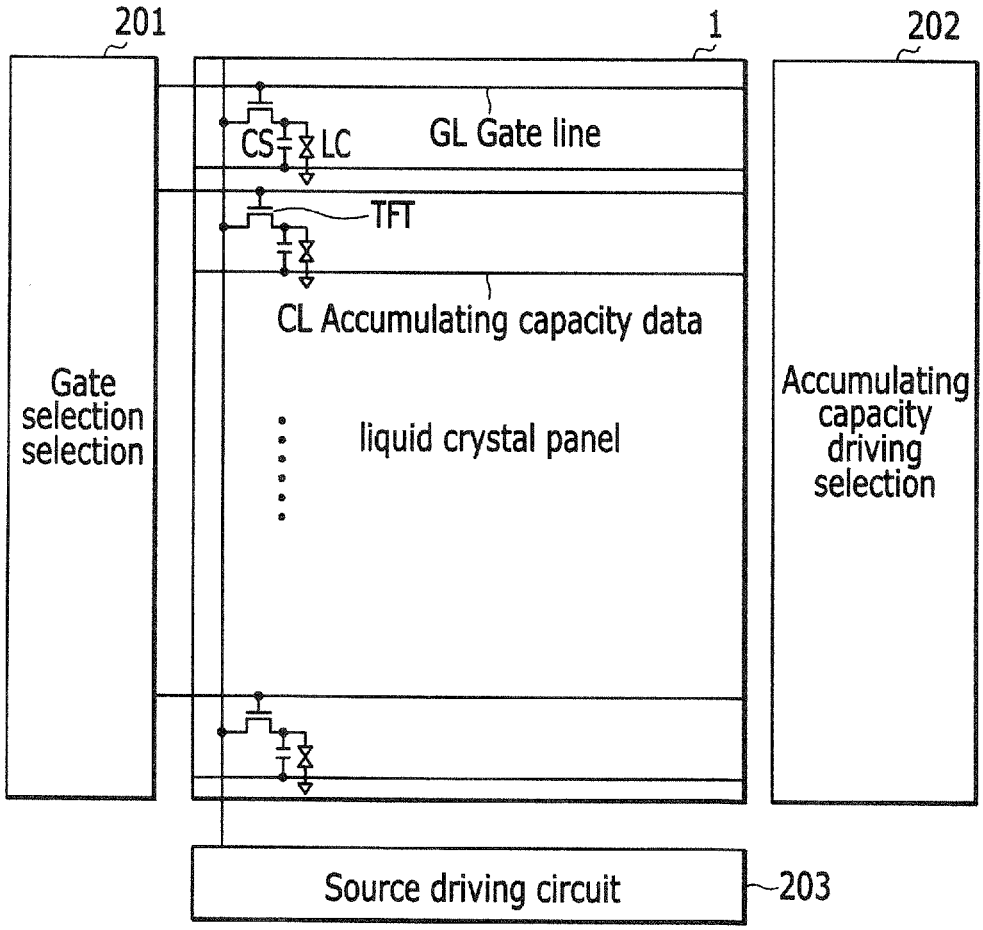
FIG. 18 is a view showing the constitution of a driving apparatus of a liquid crystal panel including a gate selection circuit and an accumulating capacity driving circuit.
Figure 19:
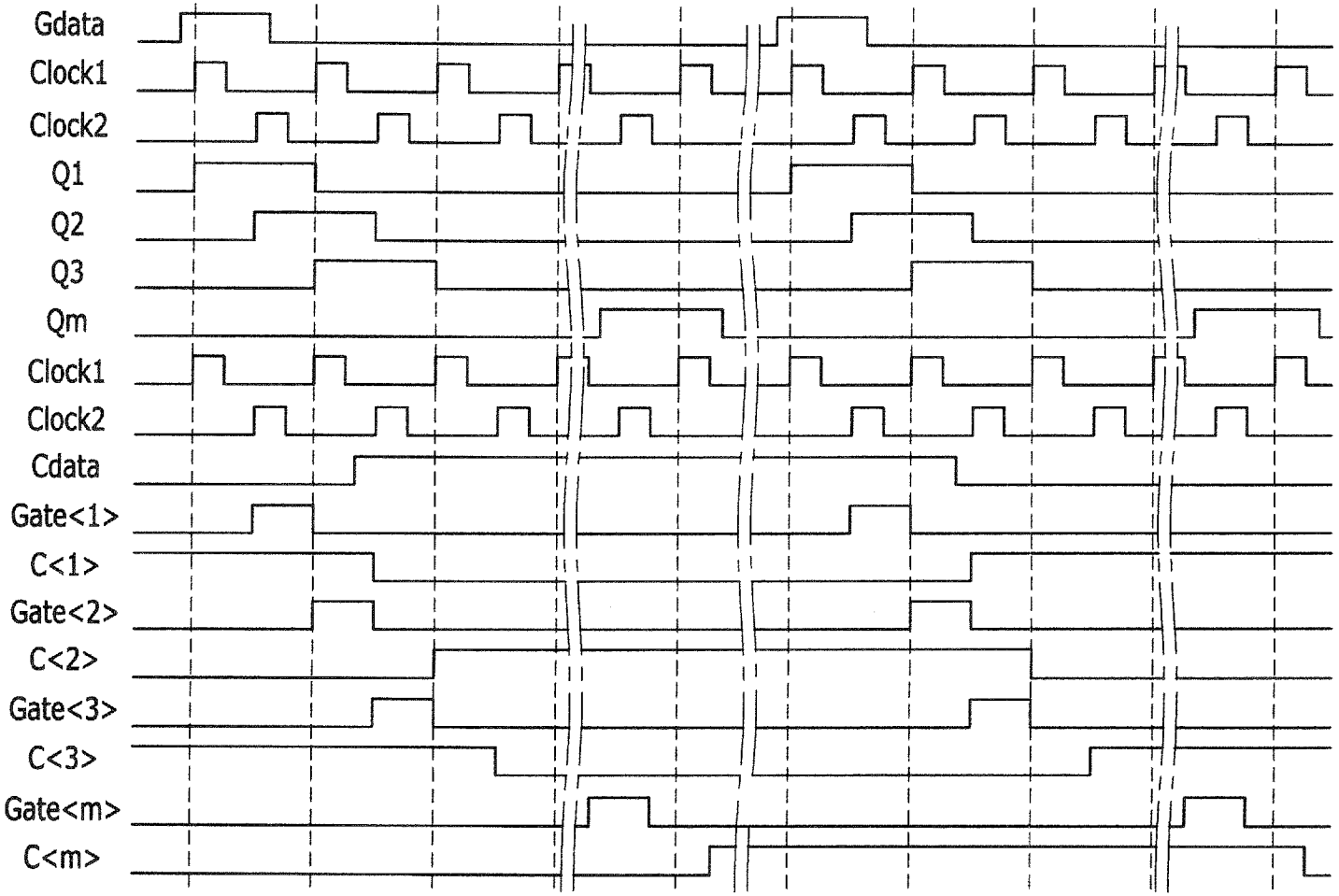
FIG. 19 is a view showing an example of a driving waveform for a driving apparatus shown in FIG. 17.

FIG. 16 is a view showing the constitution of a gate selection circuit; FIG. 17 is a view showing the constitution of an accumulating capacity driving circuit; FIG. 18 is a view showing the constitution of a driving apparatus of a liquid crystal panel including a gate selection circuit and an accumulating capacity driving circuit; FIG. 19 is a view showing an example of a driving waveform for a driving apparatus shown in FIG. 17; and FIGS. 20A and 20B are views showing the constitution of a latch circuit.

A gate selection circuit 201, as shown in FIG. 16, consists of a shift register circuit including a plurality of latch circuits LA1', and clock signals Clock1 and Clock2 may be used as clock signals of the latch circuit LA1'.

Also, gate selection signals Gate<1>-Gate<m> are generated from each output Q1-Qm of a plurality of latch circuits LA1'.

Furthermore, as shown in FIG. 20A, the latch circuit LA1' includes two clock inverters circuit CINVa and CINVb and one inverter circuit INVa.

As described above, in the gate selection circuit 201, one latch circuit LA1' is respectively required for one gate selection circuit output (one output signal among the gate selection signals Gate<1>-Gate<m>). Also, a control signal to operate the latch circuit LA1' is required.

The latch circuit shown in FIG. 20A is referred to as a general latch circuit, and the latch circuit including two inverter circuits INVc and INVd shown in FIG. 20B is referred to as a bus latch circuit.

Next, as shown in FIG. 17, an accumulating capacity driving circuit 202 includes a shift register circuit consisting of a plurality of latch circuits LA1' (referring to FIG. 20A), like the gate selection circuit 201, and the clock signals Clock1 and Clock2 may be used as clock signals of the general latch circuit LA1'. Also, an accumulating capacity driving signal C<1>-C<m> is generated from the latch circuit output.

As described above, in the accumulating capacity driving circuit 202, like the gate selection circuit 201, one latch circuit LA1' is required for one accumulating capacity driving circuit output (one output signal among the accumulating capacity driving signals C<1>-C<m>). Also, a control signal to operate the latch circuit LA1' is necessary.

An example of an entire configuration of a driving apparatus for driving a liquid crystal panel by the gate selection circuit 201 and the accumulating capacity driving circuit 202 is shown in FIG. 18. Also, an example of a driving waveform is shown in FIG. 19.

For the driving apparatus shown in FIG. 18, the liquid crystal panel 1 includes a plurality of gate lines GL arranged by a plurality of electrodes in a horizontal direction, a plurality of accumulating capacity lines CL equally arranged by a plurality of electrodes in the horizontal direction, and a plurality of source lines SL arranged by a plurality of electrodes in a vertical direction.

Also, a pixel including a thin film transistor (TFT) switch, a liquid crystal capacitor LC and an accumulating capacitor CS is formed at each intersection portion of the gate line GL and the source line SL.

Furthermore, the liquid crystal panel 1 is connected to a gate selection circuit 201 to drive the plurality of gate lines GL, an accumulating capacity driving circuit 202 to drive the plurality of accumulating capacity lines, and a source driving circuit 203 to drive the plurality of source electrodes.

For one scan period, the gate selection circuit 201 sequentially selects the TFT of the pixel connected to the gate line GL, and simultaneously writes the desired data voltage from the source driving circuit 203 to the liquid crystal LC.

Also, after writing the data voltage, by overlapping a predetermined voltage from the accumulating capacity driving circuit 202, the data written to the liquid crystal capacitor LC is converted into a voltage which is suitable for the optical characteristic of an actual liquid crystal, and the converted voltage is maintained to a next frame.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A gate selection circuit comprising:

a clock generation circuit generating an enable clock signal generated by frequency-dividing a predetermined horizontal synchronization signal synchronized with an image signal corresponding to an image to be displayed on an active matrix liquid crystal panel that includes a plurality of pixels arranged in a matrix format and has a thin film transistor switch, a liquid crystal capacitor, and an accumulating capacitor at a plurality of regions intersected by a plurality of gate lines and a plurality of accumulating capacity driving lines disposed in a horizontal direction and a plurality of source lines disposed in a vertical direction, the clock generation circuit generating a plurality of clock signals independence upon a predetermined vertical synchronization clock signal and the enable clock signal, the plurality of clock signals differing in phase from one another, and a frequency of the enable clock signal being less than a frequency of the predetermined horizontal synchronization signal;

a plurality of first latch circuits at least including a previous first latch circuit, a current first latch circuit, and a next first latch circuit and connected in series so as to form a shift register, the current first latch circuit receiving a signal output from the previous first latch circuit and outputting another signal to the next first latch circuit for shifting hold information in synchronization with the enable clock signal; and a first switch circuit installed in correspondence to the gate lines, and wherein, when supplying a clock signal to each gate line as a gate selection signal for a pixel, said first switch circuit sequentially providing the gate selection signal according to an output signal from the first latch circuit, and wherein the gate selection signal is not applied to the first latch circuits.

2. The gate selection circuit of claim 1, wherein the clock generation circuit generates at least four clock signals as the plurality of clock signals.

3. The gate selection circuit of claim 2, wherein the first latch circuits are formed of latch circuits of a number according to a number N (an even integer) of the plurality of clock signals, and the number of latch circuits forming the first latch circuits is less than 2/N of the number of the plurality of gate lines.

4. An accumulating capacity driving circuit controlled according to the gate selection signal output of the gate selection circuit of claim 3, said accumulating capacity driving circuit comprising:

a plurality of second latch circuits driving an accumulating capacitor included in the pixel; and a second switch circuit transmitting information maintained by the accumulating capacitor to the second latch circuits in response to the gate selection signal.

5. An accumulating capacity driving circuit controlled according to the gate selection signal output of the gate selection circuit of claim 2, said accumulating capacity driving circuit comprising:

a plurality of second latch circuits driving an accumulating capacitor included in the pixel; and a second switch circuit transmitting information maintained by the accumulating capacitor to the second latch circuits in response to the gate selection signal.

6. The gate selection circuit of claim 1, wherein the first latch circuits are formed of latch circuits of a number according to a number N (an even integer) of the plurality of clock signals, and the number of latch circuits forming the first latch circuits is less than 2/N of the number of the plurality of gate lines.

7. An accumulating capacity driving circuit controlled according to the gate selection signal output of the gate selection circuit of claim 6, said accumulating capacity driving circuit comprising:

a plurality of second latch circuits driving an accumulating capacitor included in the pixel; and a second switch circuit transmitting information maintained by the accumulating capacitor to the second latch circuits in response to the gate selection signal.

8. An accumulating capacity driving circuit controlled according to the gate selection signal output of the gate selection circuit of claim 1, said accumulating capacity driving circuit comprising:

a plurality of second latch circuits driving an accumulating capacitor included in the pixel; and a second switch circuit transmitting information maintained by the accumulating capacitor to the second latch circuits in response to the gate selection signal.

9. A driving apparatus comprising:

a clock generation circuit generating an enable clock signal generated by frequency-dividing a predetermined horizontal synchronization signal synchronized with an image signal corresponding to an image to be displayed an active matrix liquid crystal panel that includes a plurality of pixels arranged in a matrix format and has a thin film transistor switch, a liquid crystal capacitor, and an accumulating capacitor at a plurality of regions intersected by a plurality of gate lines and a plurality of accumulating capacity driving lines in a horizontal direction and a plurality of source lines disposed in a vertical direction, and the clock generation circuit generating a plurality of clock signals with at least four phases independence upon a predetermined vertical synchronization clock signal and the enable clock signal, the plurality of clock signals differing in phase from one another, and a frequency of the enable clock signal being less than a frequency of the predetermined horizontal synchronization signal;

a plurality of first latch circuits at least including a previous first latch circuit, a current first latch circuit, and a next first latch circuit, and connected in series, thereby forming a shift register, the current first latch circuit receiving a signal output from the previous first latch circuit and outputting another signal to the next first latch circuit for shifting hold information in synchronization with the enable clock signal;

a gate selection circuit including a first switch circuit installed in correspondence to the gate lines, and wherein, when supplying a clock signal to each gate line as a gate selection signal for a pixel, the gate selection circuit sequentially providing the gate selection signal according to an output signal from the first latch circuit; and an accumulating capacity driving circuit including a plurality of second latch circuits for driving an accumulating capacitor included in the pixel, and a second switch circuit for transmitting information maintained by the accumulating capacitor to the second latch circuit according to the gate selection signal, and wherein the gate selection signal is not applied to the first latch circuits.

10. The driving apparatus of claim 9, wherein the accumulating capacity driving circuit further includes:

a third switch circuit accessing the plurality of clock signals, and enabled by the output signal of the first latch circuit, and simultaneously outputting a clock signal in the enabled state to enable the second switch circuit;

wherein the plurality of clock signals are sequentially outputted as an output signal of the gate selection circuit in a predetermined period in which the first switch circuit is in an enabled state by the output signal of the first latch circuit; and wherein the information maintained by the accumulating capacitor is transmitted to the second latch circuit through the second switch circuit and the third switch circuit in a predetermined period in which the third switch circuit is in the enabled state by the output signal of the first latch circuit.

11. The driving apparatus of claim 10, further comprising:

a bi-direction converting circuit selecting input information inputted to the first latch circuit and selecting a direction in which hold information is shifted; and a clock signal converting circuit converting a phase sequence of the plurality of clock signals supplied to the first switch circuit and the third switch circuit;

wherein the plurality of clock signals are sequentially outputted as the output signal of the gate selection circuit in a predetermined period in which the first switch circuit is in the enabled state by the output signal of the first latch circuit;

wherein the information maintained by the accumulating capacitor is transmitted to the second latch circuit through the second switch circuit and the third switch circuit in a predetermined period in which the third switch circuit is in the enabled state by the output signal of the first latch circuit; and wherein an output sequence of output signals in the gate selection circuit and the accumulating capacity driving circuit is inverted according to the bi-direction converting circuit and the clock signal converting circuit.

12. The driving apparatus of claim 11, wherein the gate selection circuit further includes:

a first partial display circuit having an output which is determined by an output to the first latch circuit and a first partial display control signal; and a first switch circuit connected to the plurality of clock signals and enabled by the output of the first partial display circuit;

wherein the accumulating capacity driving circuit further includes a second partial display circuit having an output which is determined by the output to the first latch circuit and a second partial display control signal;

wherein the plurality of clock signals are sequentially outputted as the output signal of the gate selection circuit by a selected predetermined gate output in a predetermined period which is enabled by the output of the first partial display circuit;

wherein the information maintained by the accumulating capacitor is selectively renewed by selectively enabling the second switch circuit and the third switch circuit by the output of the second partial display circuit in a predetermined period which is enabled by an output of the first latch circuit; and wherein the output sequence of the output signals is inverted in the gate selection circuit and the accumulating capacity driving circuit according to the bi-direction converting circuit and the clock signal converting circuit.

13. The driving apparatus of claim 12, wherein the first latch circuits are formed of latch circuits of a number according to a number N (an even integer) of the plurality of clock signals, and the number of latch circuits is less than 2/N of the number of the plurality of gate lines.

14. The driving apparatus of claim 12, wherein each of the second latch circuits is a bus-type latch circuit including two inverter circuits.

15. The driving apparatus of claim 11, wherein the first latch circuits are formed of latch circuits of a number according to a number N (an even integer) of the plurality of clock signals, and the number of latch circuits is less than 2/N of the number of the plurality of gate lines.

16. The driving apparatus of claim 11, wherein each of the second latch circuits is a bus-type latch circuit including two inverter circuits.

17. The driving apparatus of claim 10, wherein the first latch circuits are formed of latch circuits of a number according to a number N (an even integer) of the plurality of clock signals, and the number of latch circuits is less than 2/N of the number of the plurality of gate lines.

18. The driving apparatus of claim 10, wherein each of the second latch circuits is a bus-type latch circuit including two inverter circuits.

19. The driving apparatus of claim 9, wherein the first latch circuits are formed of latch circuits of a number according to a number N (an even integer) of the plurality of clock signals, and the number of latch circuits is less than 2/N of the number of the plurality of gate lines.

20. The driving apparatus of claim 9, wherein each of the second latch circuits is a bus-type latch circuit including two inverter circuits.

21. A driving method of a gate selection circuit, the method comprising the steps of:

generating an enable clock signal by frequency-dividing a predetermined horizontal synchronization signal synchronized with an image signal corresponding to an image to be displayed on an active matrix liquid crystal panel that includes a plurality of pixels arranged in a matrix format and has a thin film transistor switch, a liquid crystal capacitor, and an accumulating capacitor at a plurality of regions intersected by a plurality of gate lines and a plurality of accumulating capacity driving lines disposed in a horizontal direction and a plurality of source lines disposed in a vertical direction, and generating a plurality of clock signals independence upon a predetermined vertical synchronization clock signal and the enable clock signal, the plurality of clock signals differing in phase from one another, and a frequency of the enable clock signal being less than a frequency of the predetermined horizontal synchronization signal;

shifting hold information to a plurality of first latch circuits which at least include a previous first latch circuit, a current first latch circuit, and a next first latch circuit and are connected in series so as to form a shift register, the current first latch circuit receiving a signal output from the previous first latch circuit and outputting another signal to the next first latch circuit for shifting the hold information in synchronization with the enable clock signal; and sequentially outputting gate selection signals according to an output signal from the first latch circuits when respectively supplying a clock signal to a gate line as a gate selection signal for a pixel, and wherein the gate selection signal is not applied to the first latch circuits.

* * * * *